US012460416B1

(12) United States Patent
Alloway

(10) Patent No.: US 12,460,416 B1
(45) Date of Patent: Nov. 4, 2025

(54) METAL AND STEEL SUBSTRUCTURE FRAMING SYSTEMS

(71) Applicant: New Castle Steel Inc., Marietta, GA (US)

(72) Inventor: Jason Alloway, Roswell, GA (US)

(73) Assignee: New Castle Steel Inc., Marietta, GA (US)

( * ) Notice: Subject to any disclaimer, the term of this patent is extended or adjusted under 35 U.S.C. 154(b) by 0 days.

(21) Appl. No.: 19/225,641

(22) Filed: Jun. 2, 2025

(51) Int. Cl.
*E04B 1/24* (2006.01)
*E04B 1/00* (2006.01)
*E04F 11/025* (2006.01)

(52) U.S. Cl.
CPC ..... *E04F 11/025* (2013.01); *E04B 1/003* (2013.01)

(58) Field of Classification Search
CPC .. E04B 1/003; E04B 1/0038; E04F 15/02183; E04F 11/0223; E04F 11/025; E04F 11/035; E04F 11/038
See application file for complete search history.

(56) References Cited

U.S. PATENT DOCUMENTS 3,839,840 A * 10/1974 Miller ..... E04F 11/025 52/741.2
3,909,997 A 10/1975 Eickhof
4,381,160 A * 4/1983 Grimm ..... E04F 11/1814 403/189
5,293,722 A * 3/1994 Reimann ..... E04F 11/025 52/715
5,313,756 A * 5/1994 Ways ..... E04B 1/003 52/87
5,392,575 A * 2/1995 Hoffman ..... E04B 1/003 D25/138

(Continued)

FOREIGN PATENT DOCUMENTS

CA 2221951 C 7/2002
CA 2595709 A1 9/2006

(Continued)

OTHER PUBLICATIONS

Lapeyre Stair, Alternating Tread Stairs Assembly and Installation Instructions, accessed online on JDecember 20, 2024, from https://www.lapeyrestair.com/media/ATS-Installation-Assembly.pdf.

(Continued)

*Primary Examiner* — Kyle J. Walraed-Sullivan
(74) *Attorney, Agent, or Firm* — Banner & Witcoff, Ltd.

(57) ABSTRACT

A metal and steel framing and substructure system may include a stair assembly system for an elevated metal substructure framing structure. The metal and steel framing and substructure system may include hollow stair stringers formed from single laser-cut steel sheets, each having rises and runs to define integrated steps. The system further includes handrail post brackets spanning between stringers for securing railings. The stair assembly is part of a modular metal substructure framing system comprising galvanized steel ledger tracks, joists, support beams, and vertical posts. The system also includes structural reinforcement components such as post brackets, post bases, and adjustable blocking members to improve load handling and ease of installation.

27 Claims, 33 Drawing Sheets

(56) References Cited

U.S. PATENT DOCUMENTS

| | | | | |
|---|---|---|---|---|
| 5,653,459 | A * | 8/1997 | Murphy | B60R 3/007 280/166 |
| 5,791,101 | A * | 8/1998 | Wallace | E04F 11/025 52/182 |
| 5,806,254 | A * | 9/1998 | Bennett | E04F 11/035 52/712 |
| 6,230,454 | B1 * | 5/2001 | Meagher | E04F 11/025 52/190 |
| 6,427,403 | B1 * | 8/2002 | Tambakis | E04B 1/28 52/309.1 |
| 6,688,059 | B1 * | 2/2004 | Walker | E04D 13/0477 52/847 |
| 7,434,358 | B2 * | 10/2008 | Smith | E04B 1/34342 52/302.1 |
| 8,739,489 | B2 * | 6/2014 | Weber | E04F 11/1846 52/510 |
| 10,358,827 | B1 | 7/2019 | Sorenson, Jr. | |
| 11,060,297 | B2 | 7/2021 | Erickson | |
| 11,332,940 | B2 | 5/2022 | Charles et al. | |
| 11,408,180 | B2 | 8/2022 | Bianchi | |
| 11,598,090 | B2 | 3/2023 | Burt et al. | |
| 11,643,815 | B2 | 5/2023 | Oliver et al. | |
| 11,807,189 | B2 | 11/2023 | Kay et al. | |
| 2004/0226252 | A1 * | 11/2004 | Sheldon | E04C 3/12 52/716.1 |
| 2004/0255551 | A1 * | 12/2004 | Fuhr | E04F 15/02183 52/782.1 |
| 2008/0040992 | A1 * | 2/2008 | Greenlee | E04F 11/025 52/188 |
| 2009/0056268 | A1 * | 3/2009 | Greenlee | E04B 1/2608 52/702 |
| 2009/0188183 | A1 | 7/2009 | Sorenson, Jr. | |
| 2011/0162303 | A1 | 7/2011 | Truckner et al. | |
| 2012/0042580 | A1 * | 2/2012 | Manson | E04D 13/0477 52/302.1 |
| 2014/0190092 | A1 * | 7/2014 | Klassen | E04B 1/003 52/79.5 |
| 2016/0053475 | A1 * | 2/2016 | Locker | E04C 3/28 52/73 |
| 2016/0312489 | A1 * | 10/2016 | Leary | E04H 12/2253 |
| 2018/0094432 | A1 * | 4/2018 | Burt | E04C 3/07 |
| 2018/0363306 | A1 * | 12/2018 | Esh, Jr. | E04F 17/00 |
| 2020/0109567 | A1 * | 4/2020 | Burt | E04F 11/1041 |
| 2021/0293020 | A1 * | 9/2021 | Burt | E04B 1/003 |
| 2024/0026675 | A1 * | 1/2024 | Weber | E04B 5/14 |
| 2024/0191507 | A1 | 6/2024 | Johnson et al. | |
| 2024/0191509 | A1 | 6/2024 | Ingalls | |
| 2025/0223791 | A1 * | 7/2025 | Monteer | E04B 1/388 |

FOREIGN PATENT DOCUMENTS

| | | | |
|---|---|---|---|
| CN | 207863469 | U | 9/2018 |
| CN | 210918341 | U | 7/2020 |
| CN | 211286352 | U | 8/2020 |
| CN | 212926777 | U | 4/2021 |
| CN | 213390916 | U | 6/2021 |
| CN | 215254063 | U | 12/2021 |
| CN | 115262880 | B | 10/2023 |
| DE | 202020005339 | U1 | 2/2021 |
| WO | 2023282770 | A1 | 1/2023 |
| WO | 2023178433 | A1 | 9/2023 |
| WO | 2023196822 | A2 | 10/2023 |

OTHER PUBLICATIONS

The Azek Company Inc., Decking Installation & Maintenance Guide, accessed online on Dec. 20, 2024, from https://www.timbertech.com/wp-content/uploads/2020/05/timbertech_decking_installguide.pdf.

Deckorators, Vista Decking Installation Instructions, accessed online on Dec. 20, 2024, from https://www.deckorators.com/cdn/shop/files/15557_VistaDeckingInstallationInstructions_LR.pdf?v=1475167589093081910.

Fortress Building Products, Fortress Evolution Steel Deck Stair Framing Display Installation Instructions, accessed online on Dec. 20, 2024, from https://fortressbp.com/Documents/evolution-stair-framing-display-instructions-0.pdf.

New Castle Steel, Introducing The Innovative New Castle Steel 6"x6" Support Post, accessed online on Dec. 20, 2024, from https://www.ncsteel.com/blog/introducing-the-new-castle-steel-support-post.

Outdure International Ltd., Outdure Composite Decking Installed on a Timber Sub-Frame, accessed online on Dec. 20, 2024, from https://productspec.co.nz/media/wbcel5pk/outdure-installation-guide-for-composite-decking-on-timber-framing.pdf.

Bil-Jax Inc., Quick Stair Assembly Instructions, accessed online on Dec. 20, 2024, from https://biljax.com/wp-content/uploads/2018/09/Quick-Stair-Assembly-Instructions.pdf.

* cited by examiner

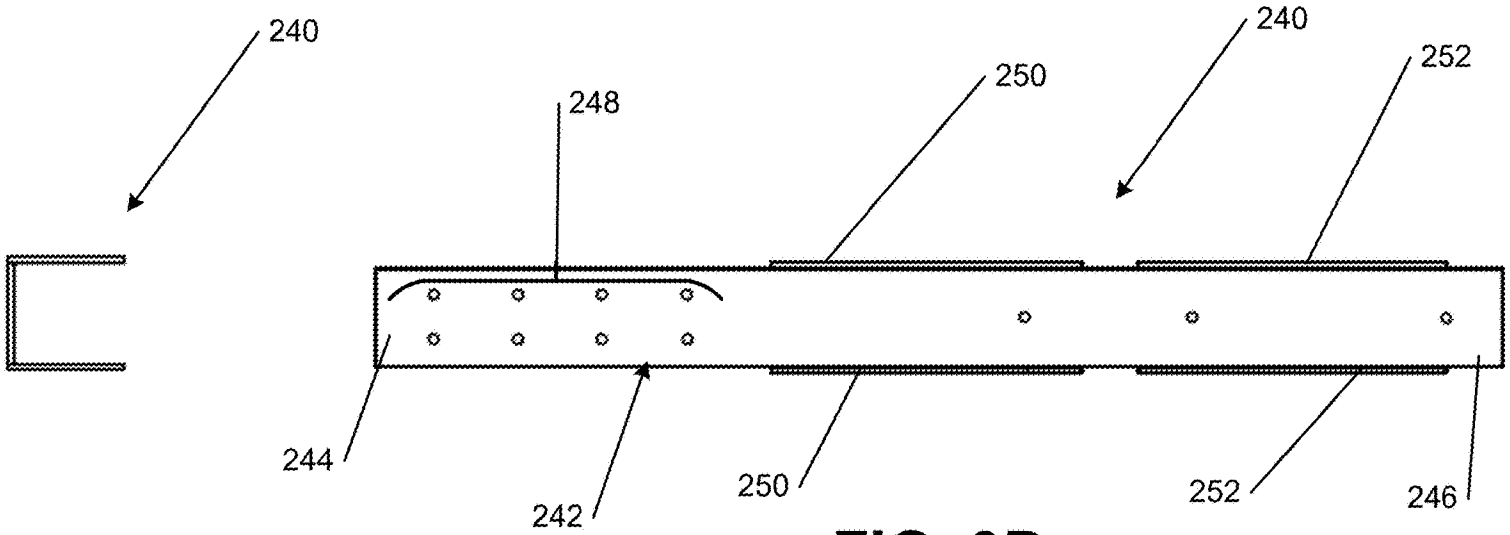
FIG. 9C
FIG. 9D
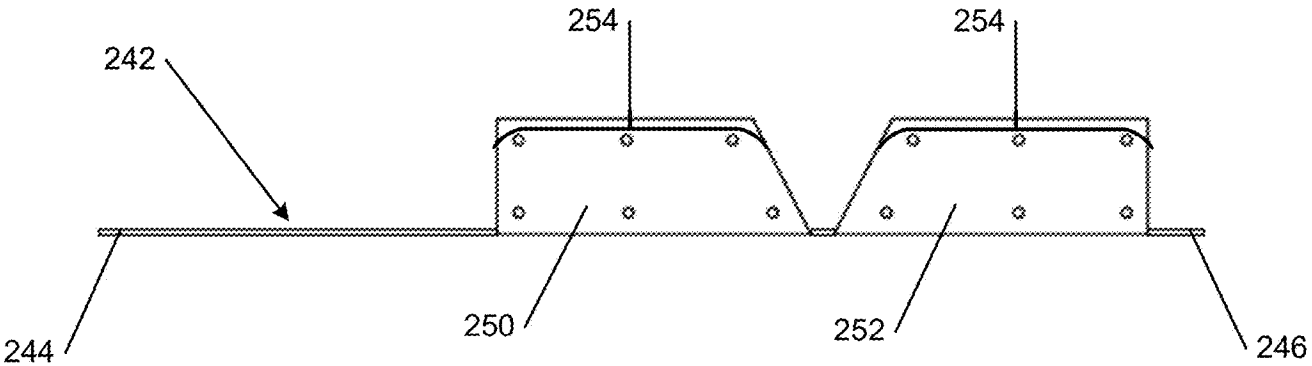
FIG. 9E

SECTION A-A

METAL AND STEEL SUBSTRUCTURE FRAMING SYSTEMS

FIELD OF THE INVENTION

The present invention relates generally to building construction systems and, more particularly, to metal and steel substructure framing systems that include integrated stair stringers for use in commercial, industrial, and residential decks and porches.

BACKGROUND

Metal framing systems are commonly used in modern construction due to their strength, durability, and ease of installation. These systems typically consist of steel joists, beams, tracks, support posts, and stairs configured to provide a support structure for floors, roofs, and elevated platforms. In multi-level construction, stair systems are also required to provide safe and stable access between floors.

Conventional stair construction methods often involve the use of precast concrete stair systems or fabricated steel stair assemblies that must be measured, cut, and welded or bolted into place during installation. This process can be labor-intensive and time-consuming, and it frequently requires specialized labor and additional onsite fabrication. Moreover, coordinating the integration of stair stringers with the surrounding framing systems can introduce further complexity and potential misalignment. Conventional stair construction methods often involve cutting pressure treated lumber into stringers.

In an effort to streamline construction processes, various stair systems and modular framing components have been developed. However, many existing solutions lack sufficient integration between stair stringers and the overall framing systems, leading to inefficiencies in load transfer, alignment, and ease of installation. Additionally, such systems may not adequately accommodate design variations or changes in elevation during construction.

Accordingly, there remains a need in the art for improved metal and steel substructure framing systems for residential and commercial decks and porches that provide enhanced integration with stair stringers. Such systems would ideally simplify installation, improve structural alignment, and offer modularity and adaptability for a range of architectural configurations.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

The present invention relates to a metal and steel substructure framing systems that includes a post and bracket assembly, a stair assembly system, and other related components. The stair assembly system may be integrated into an elevated metal substructure framing system, offering a durable, modular, and customizable stair solution using cold-formed galvanized steel components. The stair assembly includes laser-cut, foldable steel stair stringers, providing a hollow structural configuration defined by alternating rises and runs that are welded onto the sides of the laser-cut steel sheet. Each stringer is designed to support rectangular stair surface treads and can be tailored with customizable rise heights and total step count.

The system includes stair stringer brackets to mount the stringers securely to tracks or joists of the deck framing. These brackets feature bendable panels and fastener holes for adaptable and rigid connections. Handrail post brackets span between stair stringers and provide fastener-ready surfaces for mounting safety rails.

The stair assembly integrates with a metal substructure framing system that comprises ledger tracks, joists, support beams, and vertical support posts made from hollow rectangular galvanized steel sections. Additional components, such as front and rear post brackets, post bases, and adjustable mid-span and beam blocking members, enhance structural stability and load distribution. The entire system is designed for ease of assembly, structural integrity, and longevity in exterior applications.

Metal and steel substructure framing systems have various features that are described herein.

In some examples, the metal and steel substructure framing system may include a stair assembly for an elevated metal substructure framing system. The stair assembly may comprise: a plurality of stair stringers. Each stair stringer may be formed from a single laser-cut steel sheet and comprising: a first side panel including a plurality of rises, a second side panel including a plurality of runs, and a bottom panel disposed between the first and second side panels. The bottom panel may include an upper edge panel and a lower edge panel. The first and second side panels may be folded to form a hollow structural member with steps defined by the rises and runs. The stringers may be laser cut and bent to create the shape of the stringer with the rises and runs cut out. The flat rises and runs that the treads are attached to may be welded on to the stringers.

Additionally, the stair assembly may further comprise one or more stair stringer brackets configured to attach at least one of the stair stringers to a track or joist of the metal substructure framing system. Each stair stringer bracket may comprise: a base panel having a first end configured to attach to the track or joist of the metal substructure framing system and a second end configured to attach to the stair stringer, wherein the base panel is bendable between the first end and the second end, a pair of mid-wing panels extending from the base panel and configured to attach to the stair stringer, a pair of bottom wing panels extending from the base panel and configured to attach to the stair stringer, and a plurality of fastener holes for securing the bracket to the metal substructure framing system and the stair stringer.

Additionally, the stair assembly may further comprise a pair of stair stringer handrail post brackets configured to attach to a handrail post. The stair stringer handrail post brackets may be configured to span between two adjacent stair stringers. The handrail post brackets may comprise: a top bar having at least one slot for a fastener to secure a handrail post or base, a bottom bar having at least one fastener hole for ground attachment, two side bars with fastener holes to secure to adjacent stair stringers, and a post tab extending laterally with a vertical offset from the top bar and having a fastener hole for the handrail post attachment. The top bar, the bottom bar, and the two side bars may form a rectangular shaped bracket.

In another embodiment, a metal substructure framing system may comprise: at least one ledger track configured for attachment to an upright structure; at least one track positioned opposite the ledger track; a plurality of joists spanning between the ledger track and the track; at least one support beam extending underneath and transversely across the plurality of joists; a plurality of vertical support posts extending downward from the framing system to a foundation or ground surface; and a stair assembly coupled to at least one end of the system to provide access between the elevated deck and the ground. The ledger track, the track, the joists, and the support beams may each comprise a hollow rectangular cross-section fabricated from galvanized steel. The stair assembly may comprise: a plurality of stair stringers, a plurality of stair stringer brackets configured to connect each of the stair stringers to the track or the joist of the metal substructure framing system, and a pair of stair stringer handrail post brackets configured to attach to a handrail post. Each stair stringer may be formed from a single laser-cut steel sheet and comprising a plurality of rises and a plurality of runs. The stair stringers may form a hollow structural member with steps defined by the rises and runs. Each stair surface tread may be rectangular. The stair stringer handrail post brackets may be configured to span between two adjacent stair stringers.

These and various other features will be described more fully herein.

BRIEF DESCRIPTION OF THE DRAWINGS

The present invention is illustrated by way of example and not limited in the accompanying figures in which like reference numerals indicate similar elements and in which:

FIG. 9C is an end perspective view of the stair stringer bracket from FIG. 9B according to one or more aspects described herein.

FIG. 9D is a top perspective view of the stair stringer bracket from FIG. 9B according to one or more aspects described herein.

FIG. 9E is a side perspective view of the stair stringer bracket from FIG. 9B according to one or more aspects described herein.

Further, it is to be understood that the drawings may represent the scale of different components of one single embodiment; however, the disclosed embodiments are not limited to that particular scale.

DETAILED DESCRIPTION

Aspects of this disclosure relate to a metal and steel framing and substructure system may include a stair assembly system for an elevated metal substructure framing structure. The metal and steel framing and substructure system may include hollow stair stringers formed from single laser-cut steel sheets, each having rises and runs to define integrated steps. The stringers support rectangular stair surface treads and attach to the framing system via custom brackets. The system further includes handrail post brackets spanning between stringers for securing railings. The stair assembly is part of a modular metal substructure framing system comprising galvanized steel ledger tracks, joists, support beams, and vertical posts. The system also includes structural reinforcement components such as post brackets, post bases, and adjustable blocking members to improve load handling and ease of installation.

These and various other features and aspects of the metal/steel framing and substructure systems will be described more fully herein.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1:
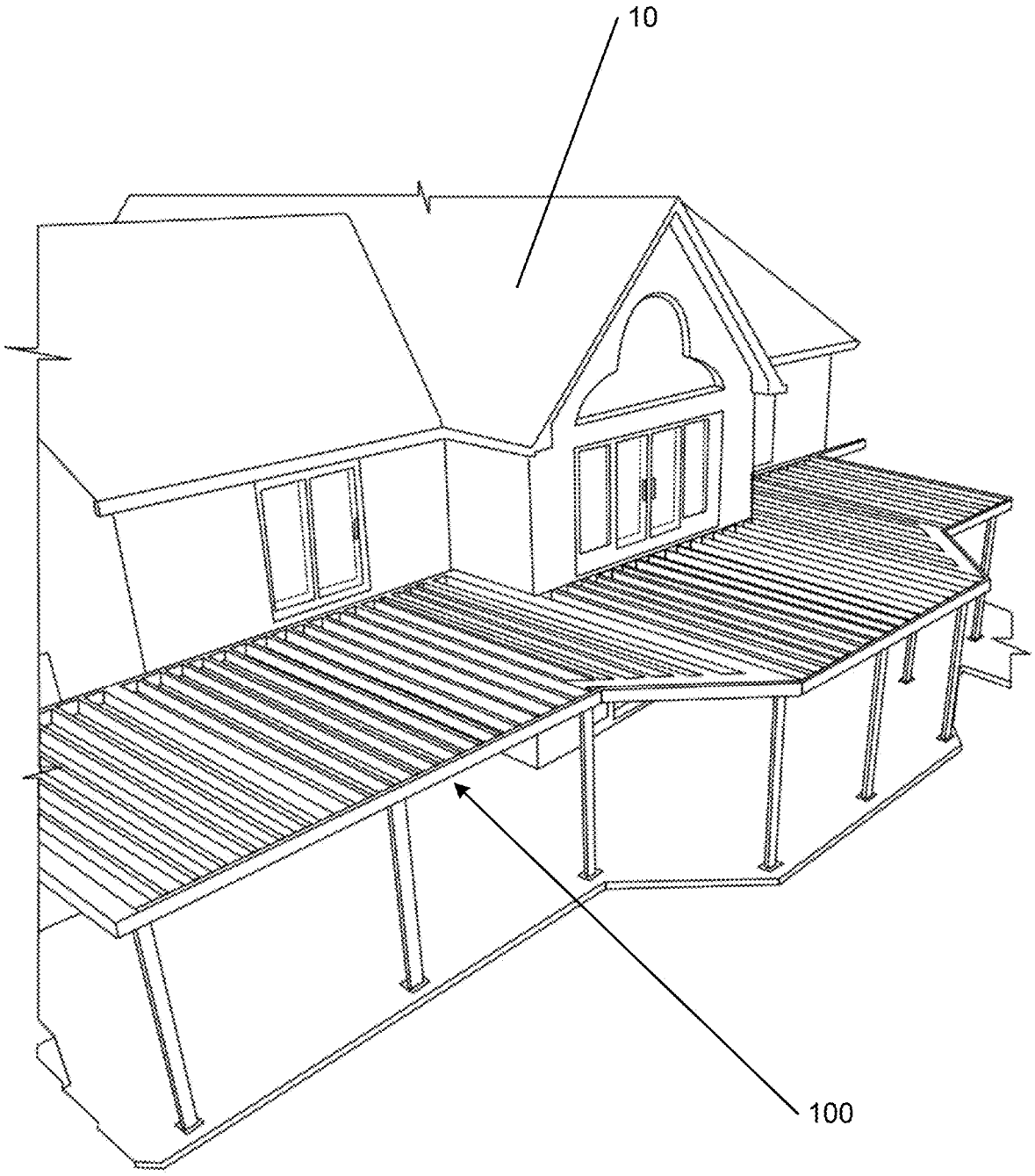
FIG. 1 is a top perspective view of an exemplary metal and steel framing and substructure system installed on a home according to one or more aspects described herein.
Figure 2:
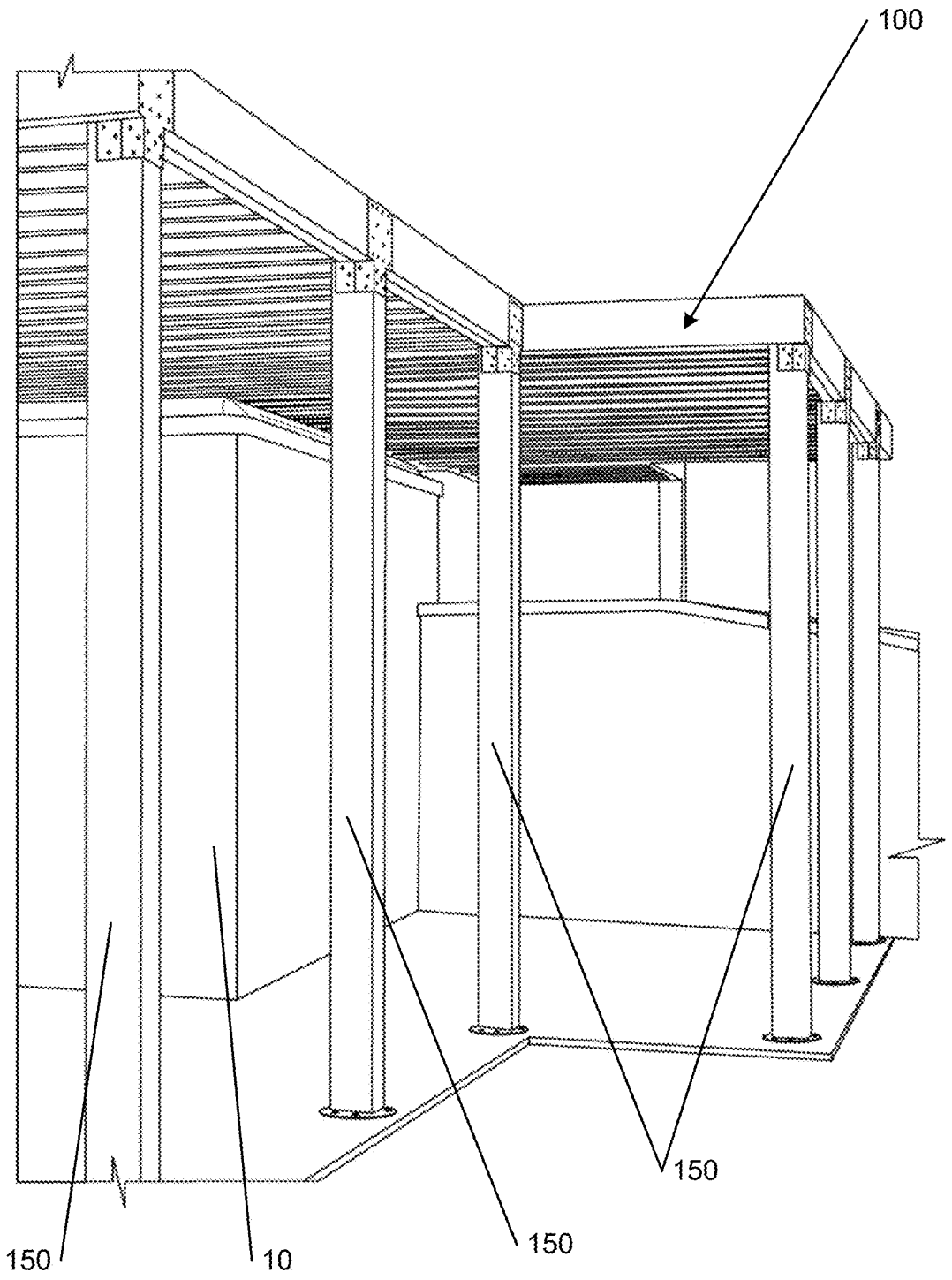
FIG. 2 is a bottom perspective view of the metal and steel framing and substructure system from FIG. 1 according to one or more aspects described herein.
Figure 3:
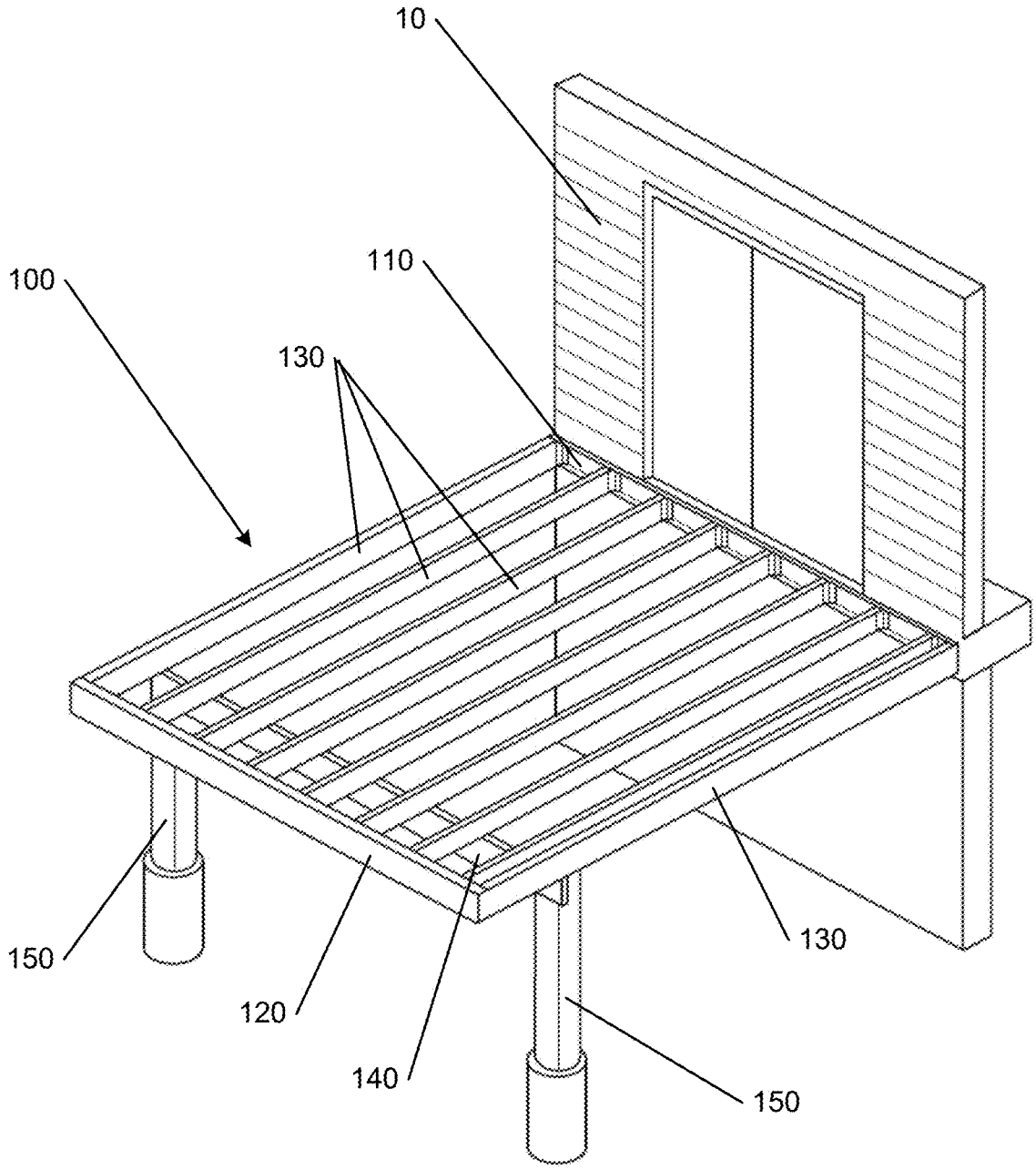
FIG. 3 is a top perspective view of another exemplary metal and steel framing and substructure system installed on a home according to one or more aspects described herein.
Figure 4A:
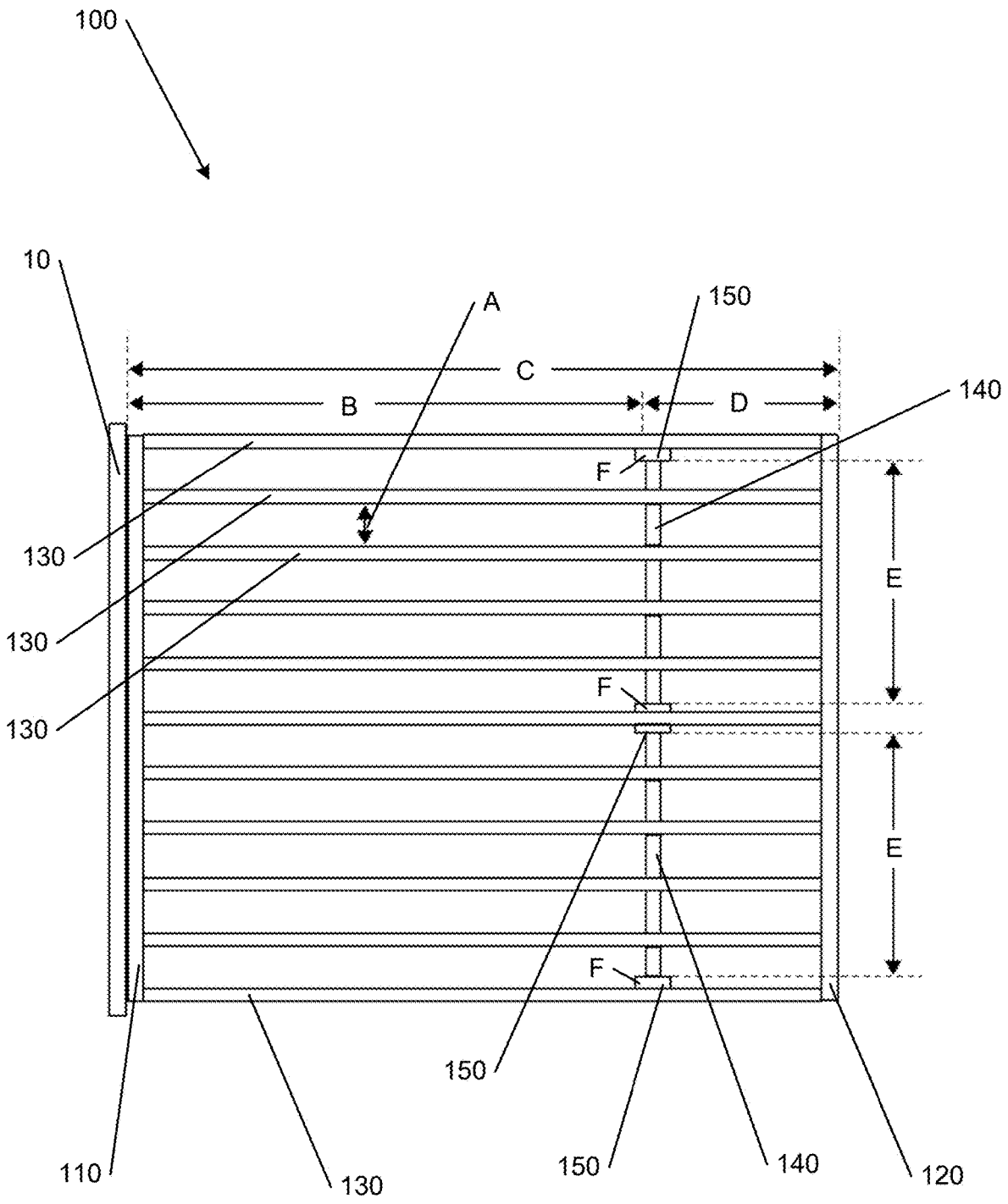
FIG. 4A is a top view of another exemplary metal and steel framing and substructure system with a single beam configuration according to one or more aspects described herein.
Figure 4B:
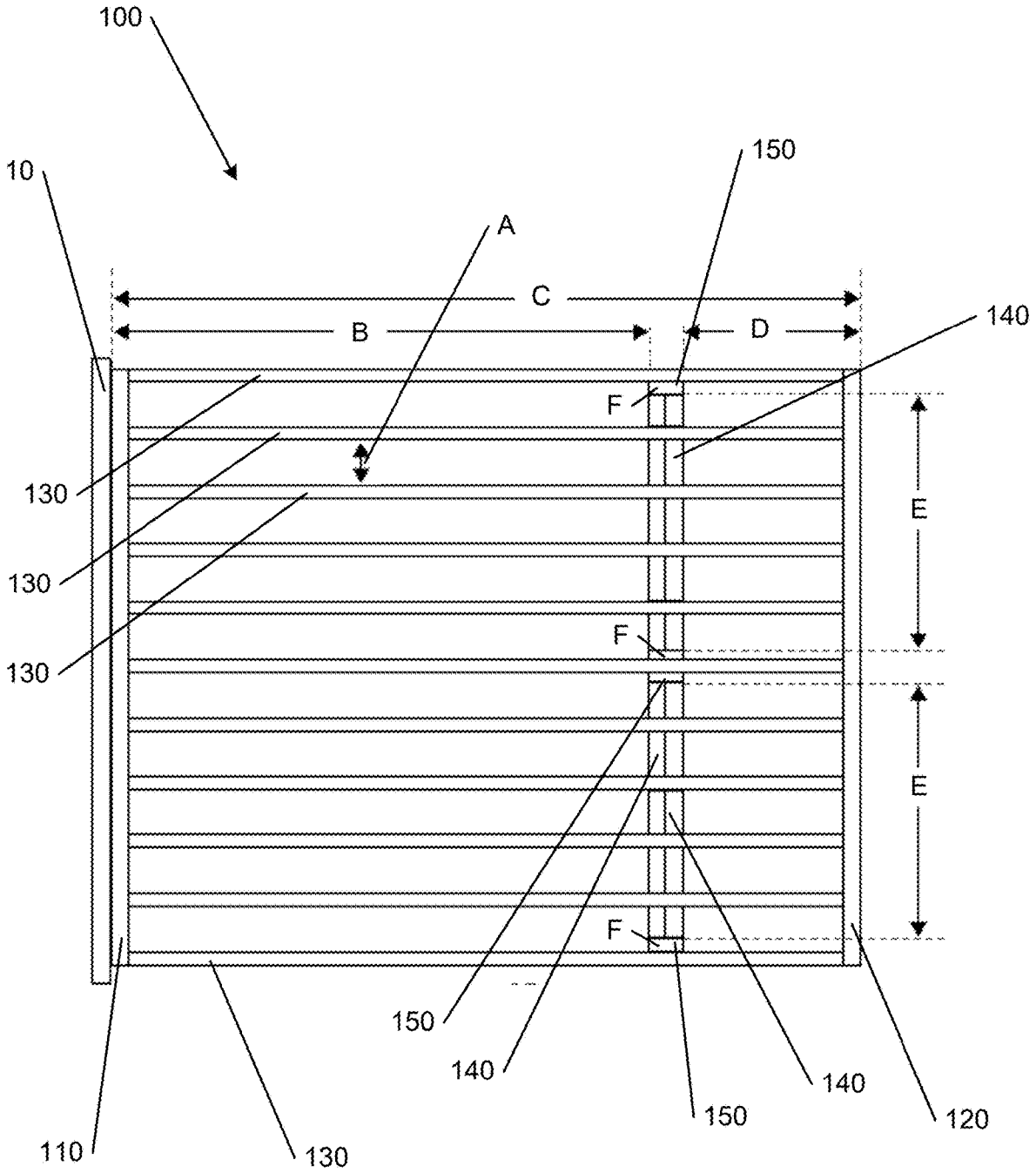
FIG. 4B is a top view of another exemplary metal and steel framing and substructure system with a double beam configuration according to one or more aspects described herein.

FIGS. 1-4B depict various views and examples of a metal substructure framing system 100 in accordance with aspects described herein. FIG. 1 depicts a perspective top view of a metal substructure framing system 100 installed on an exemplary house 10. FIG. 2 depicts a perspective bottom view of another example metal substructure framing system 100 installed on an exemplary house 10. FIG. 3 depicts a perspective top view of another example metal substructure framing system 100 installed on an exemplary house 10. FIGS. 4A and 4B depict top views of example metal substructure framing systems 100. As shown in FIGS. 1-4B, the metal substructure framing system 100 may include a ledger track 110, a track 120 opposite the ledger track 110, and a plurality of joists 130 spanning between the ledger track 110 and the track 120. The metal substructure framing system 100 may include one or more ledger tracks 110 and one or more tracks 120.

When the metal substructure framing system 100 is mounted adjacent to an upright structure, such as a house 10 or a building wall, the joists 130 may be supported at one end on a ledger track 110. One or more ledger tracks 110 may extend laterally across the width of the assembled metal substructure framing system 100. The one or more ledger tracks 110 may be installed closest to the house 10 or building wall and may be fastened to the house 10 or building wall. The metal substructure framing system 100 may include one or more support beams 140 extending across the plurality of joists 130 and underneath the plurality of joists 130. The support beams 140 may be either single beam 140A as shown in FIGS. 4A and 5C, or double beam 140B as shown in FIGS. 4B and 5E.

The metal substructure framing system 100 may also include a plurality of support posts 150 standing perpendicular to the plane of the metal substructure framing system 100. The support posts 150 may be vertical and extend from a foundation or the ground providing the vertical support for the metal substructure framing system 100. The support posts 150 may support the metal substructure framing system 100 elevated from a foundation of the ground. The support posts 150 may also provide support around the metal substructure framing system 100 on top of the deck. When the metal substructure framing system 100 is elevated from the ground, a stair assembly 200 may be used for connection between one or multiple ends of the metal substructure framing system 100 and the ground. The stair assembly 200 will be detailed more below and further shown in FIGS. 7A-12.

The ledger track 110, the track 120, the joists 130, and the support beams 140 may be various lengths, such as, for example, 12 feet, 16 feet, or 20 feet. The joists 130 may include various thicknesses also, such as, for example, 15/8 inches or 2 inches. The support posts 150 may be a square or rectangular shaped post, such as a 6 inch by 6 inch post. The support posts 150 may be various lengths, such as, for example, 10 feet or 20 feet. Other lengths, thicknesses, and shapes for the ledger track 110, the track 120, the joists 130, the support beams 140, and the support posts 150 may be used without departing from the invention. Additionally, the ledger track 110, the track 120, the joists 130, the support beams 140, or the support posts 150 may be cut to any lengths less than the exemplary lengths provided.

FIGS. 4A and 4B show many of the various components along with various spans and distances for an exemplary metal substructure framing system 100. FIG. 4A shows a top view of a metal substructure framing system 100 with a single support beam 140A. FIG. 4B shows a top view of a metal substructure framing system 100 with a double support beam 140B.

As shown in FIGS. 4A and 4B, "A" depicts joist spacing A which is the allowable space between individual joists 130. The joists 130 may have a joist spacing A of 12 inches or 16 inches. Even if a 16 inch joist spacing A is acceptable, a 12 inch joist spacing A may chosen to achieve a greater joist span B.

"B" depicts joist span B which is the maximum distance the joist 130 can span from track 110/120 to support beam 140 or support beam 140 to support beam 140 when joists 130 are spaced on either 12 inch or 16 inch joist spacing A.

"C" depicts the overall length C of the metal substructure framing system 100. The overall desired length C or depth of the metal substructure framing system 100 may not exceed the distant determined with the joist span B without using one or more support beams 140 and cantilevers D.

"D" depicts the cantilever D which is the overhanging of the joists 130 beyond the support beam 140 and/or support beams 140 overhanging beyond the support post 150. If the desired length C of the metal substructure framing system 100 is greater than the maximum joist span B, a cantilever may be needed to obtain the overall size of the desired length C of the metal substructure framing system 100. The cantilever D may be changed according to preference as long as it is less than a maximum cantilever span.

Deck length $C$−Maximum joist span $B$=Cantilever $D$

"E" depicts the beam span E which is the distance between support posts 150. Based on the joist span B and the cantilever D, the beam span E may determined by the number of support posts F.

"F" depicts the number of support posts 150 required F. The number of support posts 150 required F may be determined based on the maximum beam span E. The number of support posts 150 required F may be determined by dividing the desired length C of the metal substructure framing system 100 by the beam span E, rounding this number up and adding 1.

As can be seen in FIGS. 1-4B, the metal substructure framing system 100 may be any size, shape, configuration, etc. FIGS. 1 and 2 depict a more complex-shaped metal substructure framing system 100, while FIGS. 3, 4A, and 4B depict a simple rectangular/square shaped metal substructure framing system 100. The metal substructure framing system 100 fastens to the house 10 using the one or more ledger tracks 110 attached to the house 10.

The ledger track 110, the track 120, the joists 130, and the support beams 140 may comprise a hollow rectangular cross-section fabricated from galvanized steel, characterized by a wall thickness 112 in the range of 0.04-0.10 inches, for example 14 gauge (approximately 5/64"/0.0781") or 18 gauge (approximately 0.0478"). The ledger track 110, the track 120, the joists 130, and the support beams 140 may be created using a joist panel 132 and a track section 134 as will be explained later with reference to FIGS. 5A-5E.

Figure 5A:
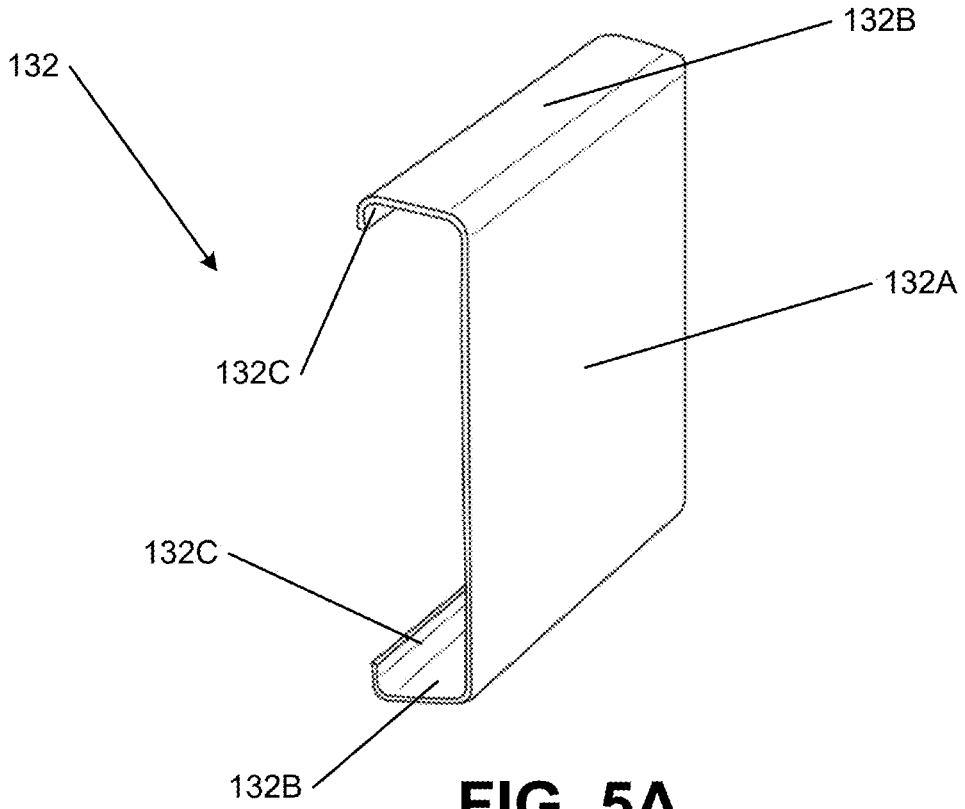
FIG. 5A is a side perspective view of an exemplary joist panel according to one or more aspects described herein.
Figure 5B:
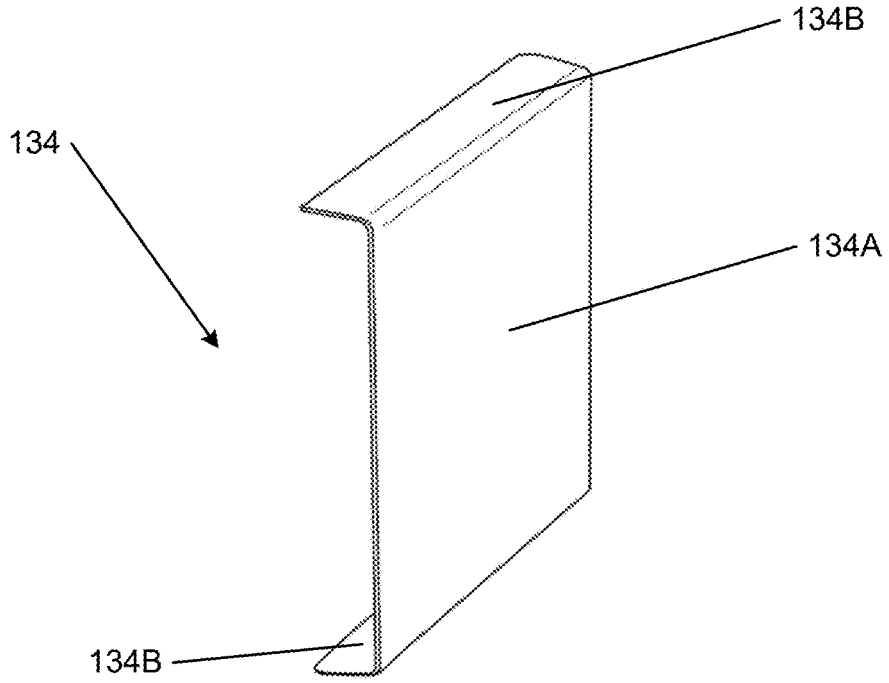
FIG. 5B is a side perspective view of an exemplary track section according to one or more aspects described herein.
Figure 5C:
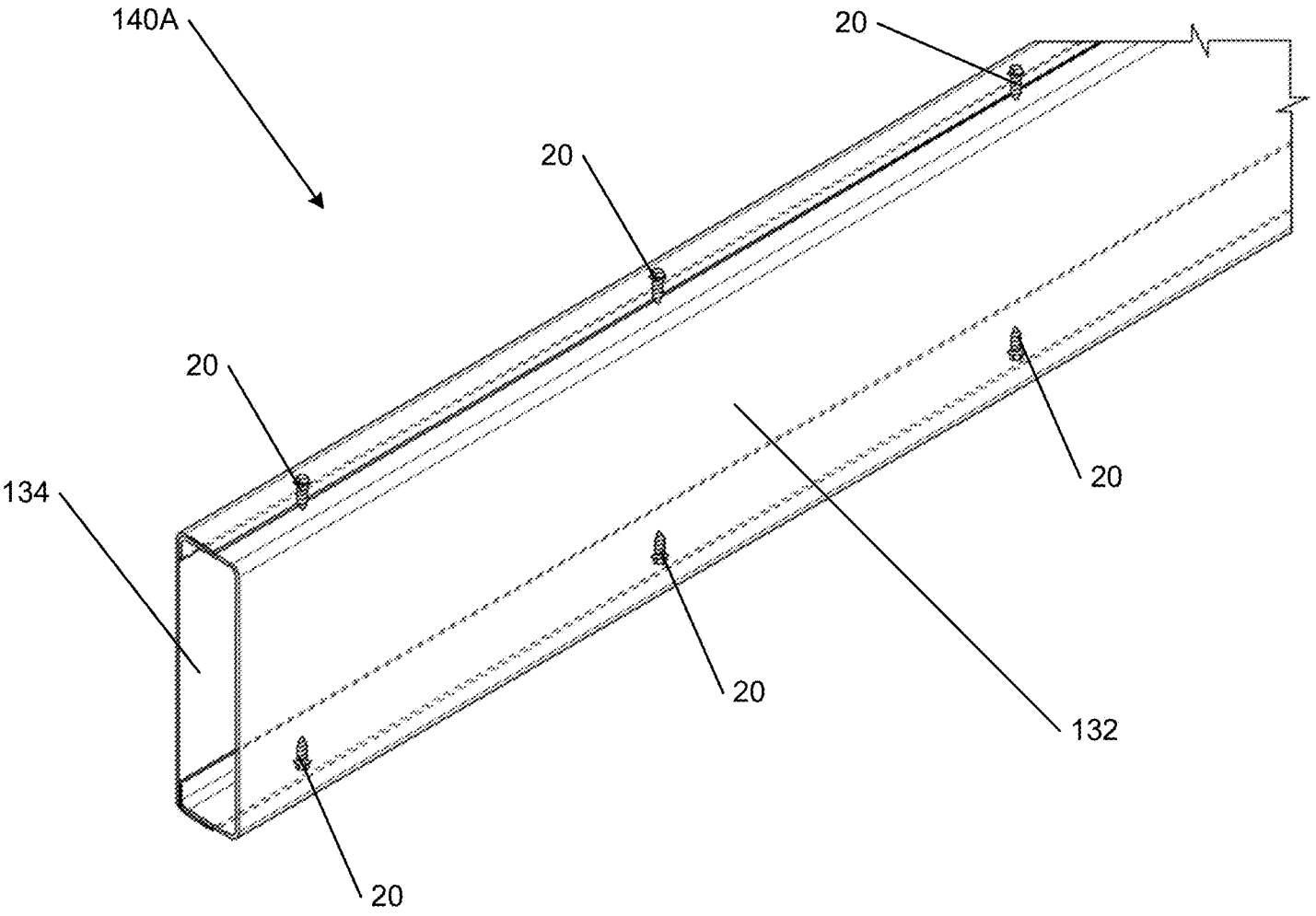
FIG. 5C is a side perspective view of an exemplary single beam configuration according to one or more aspects described herein.
Figure 5D:
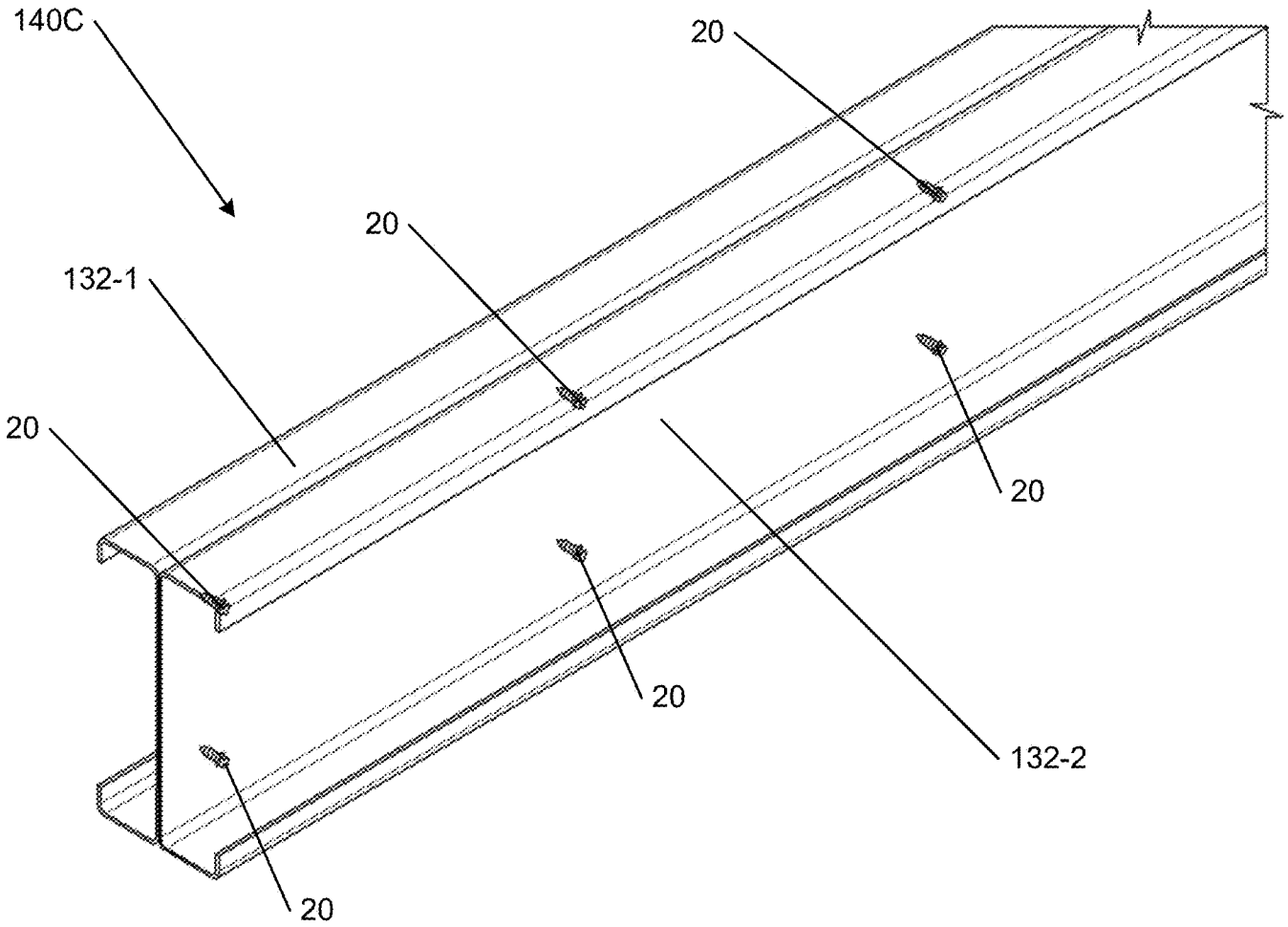
FIG. 5D is a side perspective view of an exemplary open beam configuration according to one or more aspects described herein.
Figure 5E:
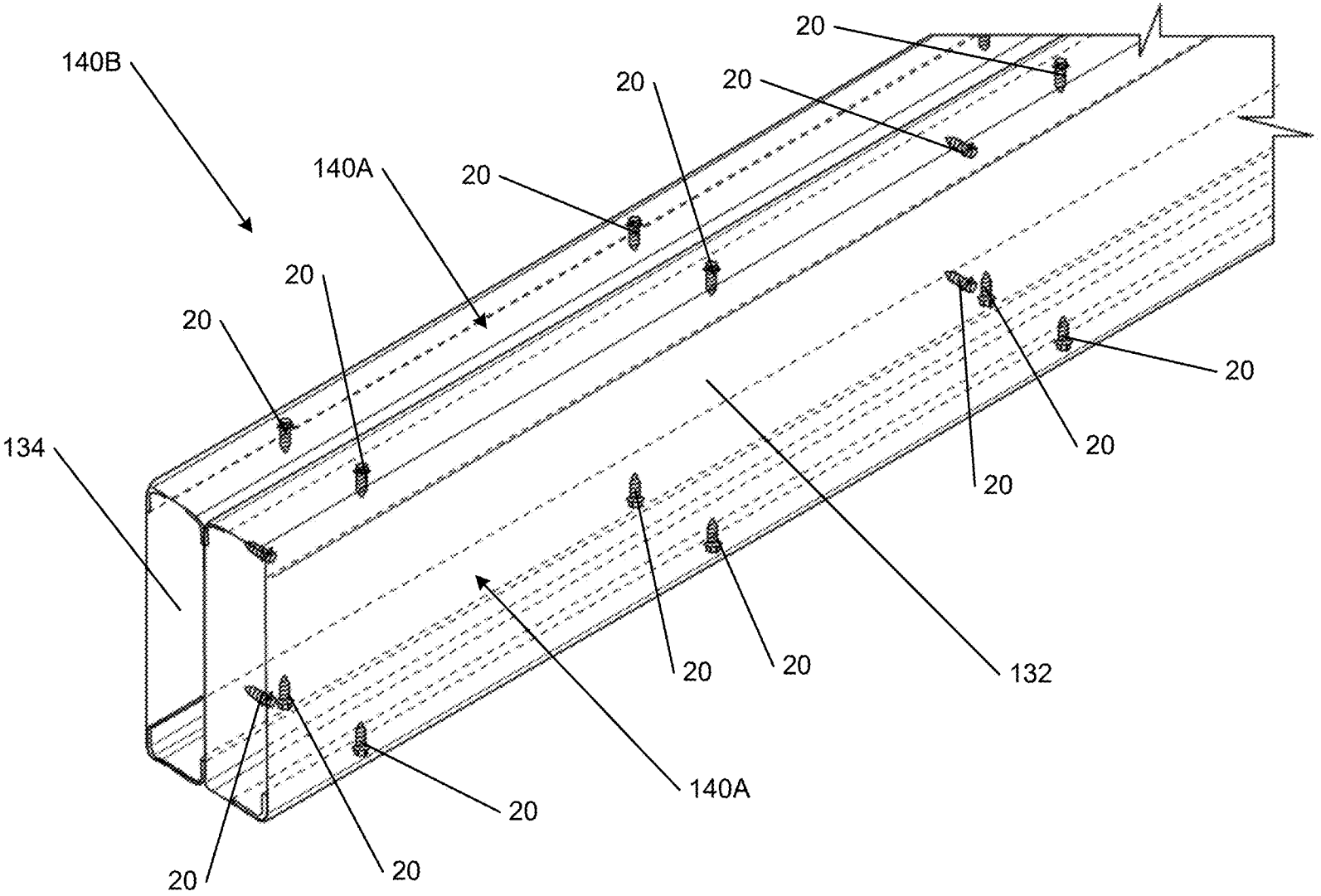
FIG. 5E is a side perspective view of an exemplary double beam configuration according to one or more aspects described herein.

FIGS. 5A-5E depict exemplary beam configurations and constructions. FIG. 5A depicts an exemplary joist panel 132. FIG. 5B depicts an exemplary track section 134. FIG. 5C depicts an exemplary single beam configuration 140A. FIG. 5D depicts an exemplary open beam configuration 140C. FIG. 5E depicts an exemplary double beam configuration 140B. As shown in FIG. 5A, the joist panel 132 may be in the form of a C-shaped channel or C-channel. The joist panel 132 may include a vertical web 132A and two horizontal flanges 132B extending from the top and bottom of the vertical web 132A, forming a "C" shape. The flanges 132B may include a curved return leg 132C that is generally parallel to the vertical web 132A, which may be for added strength or to aid in fitting with other components. As shown in FIG. 5B, the track section 134 may be in the form of a C-shaped channel or C-channel. The track section 134 may include a vertical web 134A and two horizontal flanges 134B extending 90 degrees from the vertical web 134A.

FIG. 5C depicts an exemplary single beam configuration 140A. The single beam 140A may include a joist panel 132 and a track section 134. The joist panel 132 and the track section 134 may be attached together with the horizontal flanges 132B and the return leg 132C of the joist panel 132 fastened to the horizontal flanges 134B of the track section 134. The horizontal flanges 132B may be attached to the horizontal flanges 134B using fasteners 20, such as self-tapping fasteners.

FIG. 5D depicts an exemplary open beam configuration 140C. The open beam 140C may include two joist panels, with a first joist panel 132-1 and a second joist panel 132-2. The first joist panel 132-1 and the second joist panel 132-2 may be attached together by attaching the vertical webs 132A of both panels together. The vertical webs 132A of the first joist panel 132-1 and the second joist panel 132-2 may be attached using fasteners 20, such as self-tapping fasteners.

FIG. 5E depicts an exemplary double beam configuration 140B. The double beam 140B may include two joist panels 132 and two track sections 134. Similar to the single beam 140A configuration, the joist panel 132 and the track section 134 may be attached together with the horizontal flanges 132B and the return leg 132C of the joist panel 132 fastened to the horizontal flanges 134B of the track section 134 to create two single beams. The single beams 140A may then be attached together to create the double beam 140B. Triple beam configurations may also be created using three single beams 140A, attaching all three single beams 140A. The horizontal flanges 132B may be attached to the horizontal flanges 134B using fasteners 20, such as self-tapping fasteners. Additionally, each of the single beams 140A may be attached to the other single beams 140A using fasteners 20, such as self-tapping fasteners.

The support posts 150 may comprise a hollow square or rectangular cross-section fabricated from galvanized steel, characterized by a wall thickness 152 of approximately ⅛" thick or 11 gauge wall thickness. The support posts 150 may be 6"×6" square.

Figure 6:
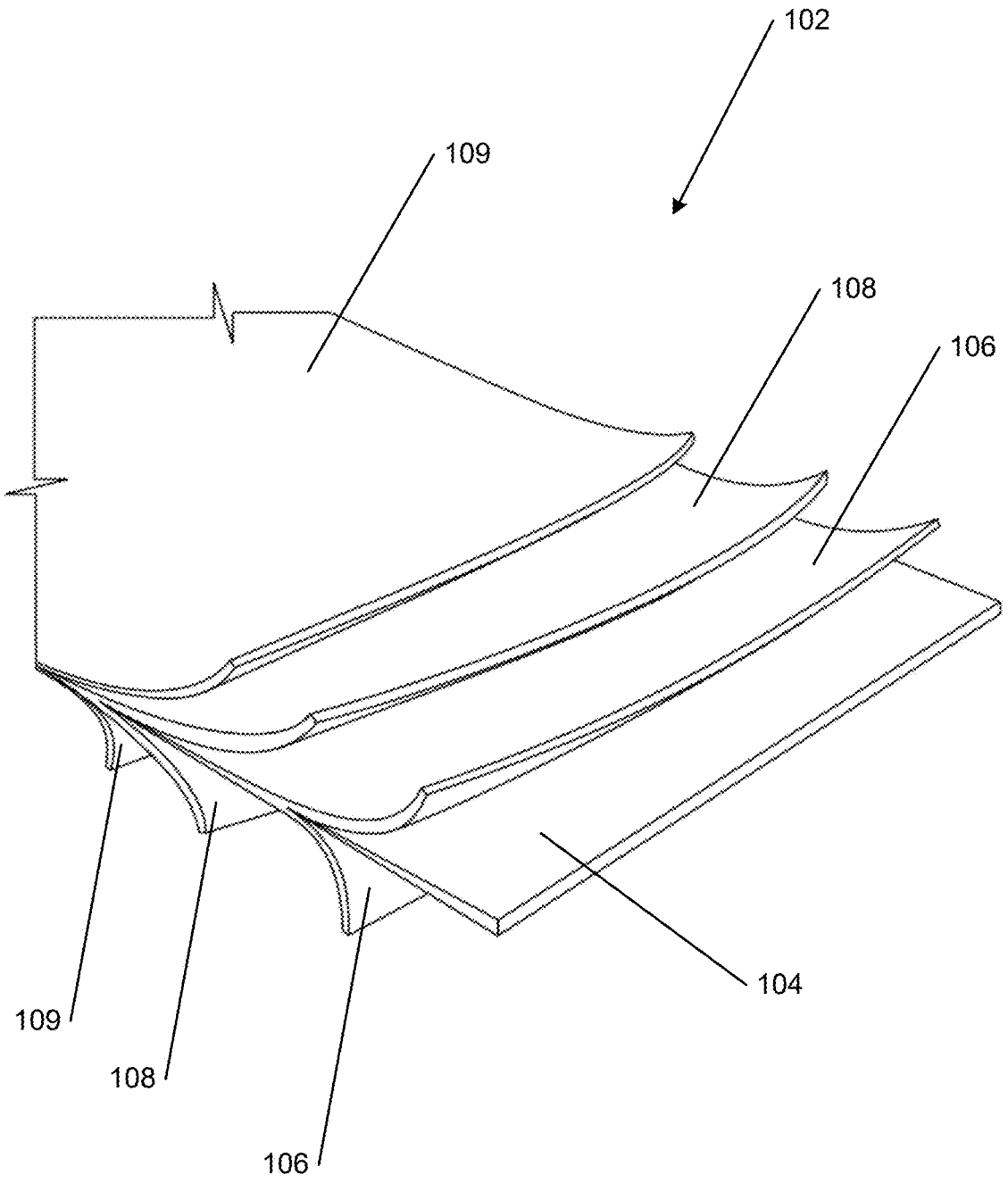
FIG. 6 is a layer view of an exemplary triple-coated material for the various components of the metal and steel framing and substructure system according to one or more aspects described herein.

The components of the metal substructure framing system 100 may be made of various materials. For example, the ledger track 110, the track 120, the joists 130, the support beams 140, and the support posts 150 may be made of a light gauge steel framing that may be used for outdoor use. The metal substructure framing system 100 may be made of cold-formed steel components. The metal substructure framing system 100 may provide a durable material, such as a triple-coated steel material. The triple-coated steel material may be a 14-gauge G60 galvanized steel that is powder-coated or other gauges without departing from the invention. FIG. 6 shows an exemplary triple-coated material 102 for the ledger track 110, the track 120, the joists 130, the support beams 140, and the support posts 150. The triple-coated material 102 may provide superior durability with three layers of protection surrounding a carbon steel core 104, with a first layer 106 with a hot-dipped galvanized coating next to the carbon steel core 104, a second layer 108 with a baked-on prime coat next to the second layer 108, and a third exterior layer 109 with a baked-on exterior with high-performance polyester coating. The triple-coated material 102 may ensure each critical ledger track 110, track 120, joist 130, support beam 140, and support post 150 connection holds up to the exterior elements for decades. The metal substructure framing system 100 may also include and provide a safe, non-combustible, rot-proof, and termite-proof material. The metal substructure framing system 100 may also provide a sustainable material, utilizing at least 25% recycled steel, that is 100% recyclable. The metal substructure framing system 100 may also be code-listed for exterior use.

The metal substructure framing system 100 may include various components and parts, some of which will be explained in more detail below. The various components and parts of the metal substructure framing system 100 may include one or more of the following: "L" brackets, mid-span blockings, beam blockings, beam endcaps, double beam endcaps, stair straps, double beam hangers, single beam hangers, metal clips, front post brackets, back post brackets, post bases, post caps, helical post bases, and dual-hardness self-drilling steel framing screws.

When the metal substructure framing system 100 is elevated from the ground, a stair assembly 200 may be used for connection between one or multiple tracks 120 or the joists 130 of the metal substructure framing system 100 and the ground. As shown in FIGS. 8A-8D, the stair assembly 200 may include a plurality of stair stringers 210, one or more stair stringer brackets 240, and one or more stair stringer handrail post brackets 270.

Figure 7A:
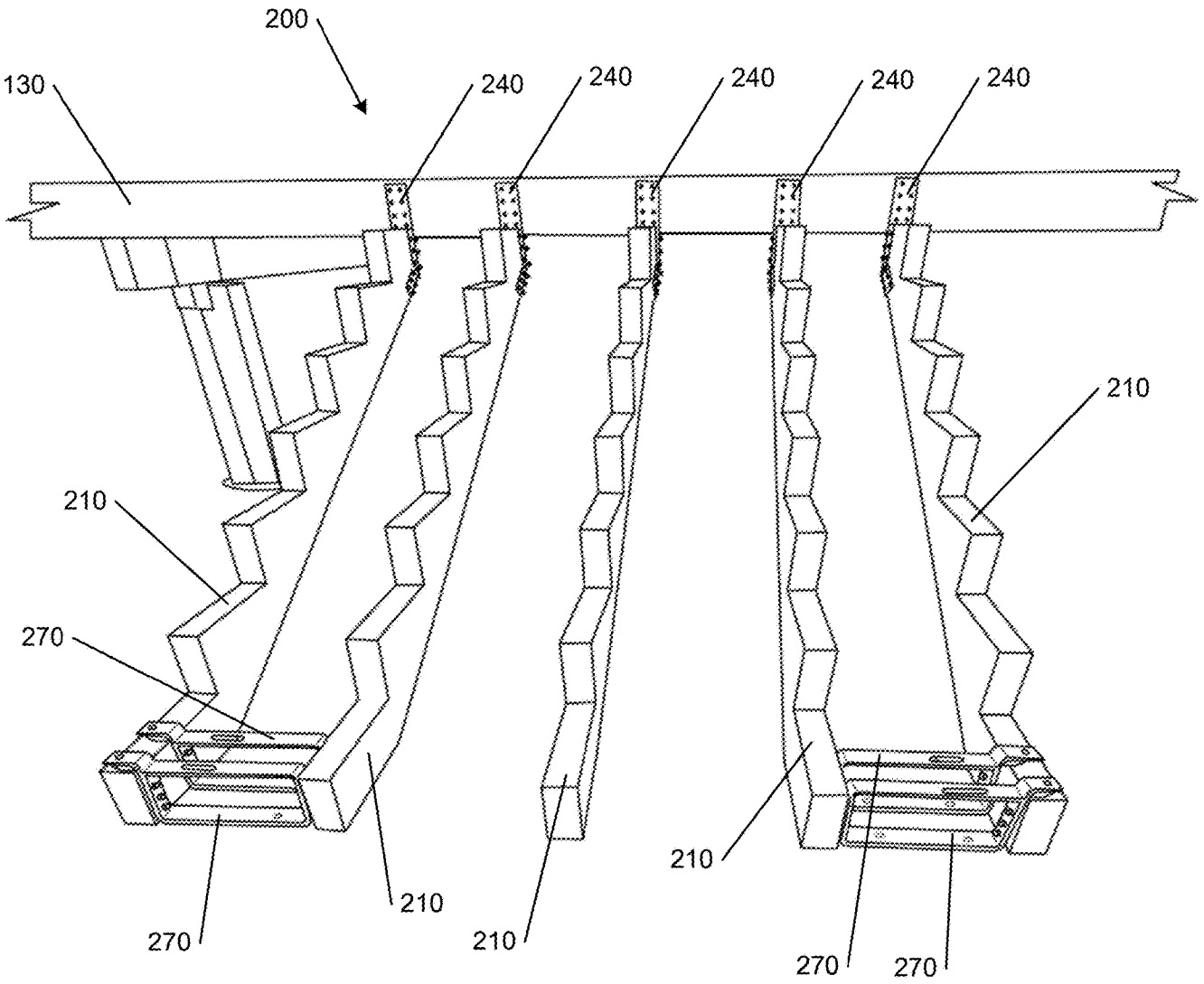
FIG. 7A is a front perspective view of an exemplary stair assembly for the metal and steel framing and substructure system according to one or more aspects described herein.
Figure 7B:
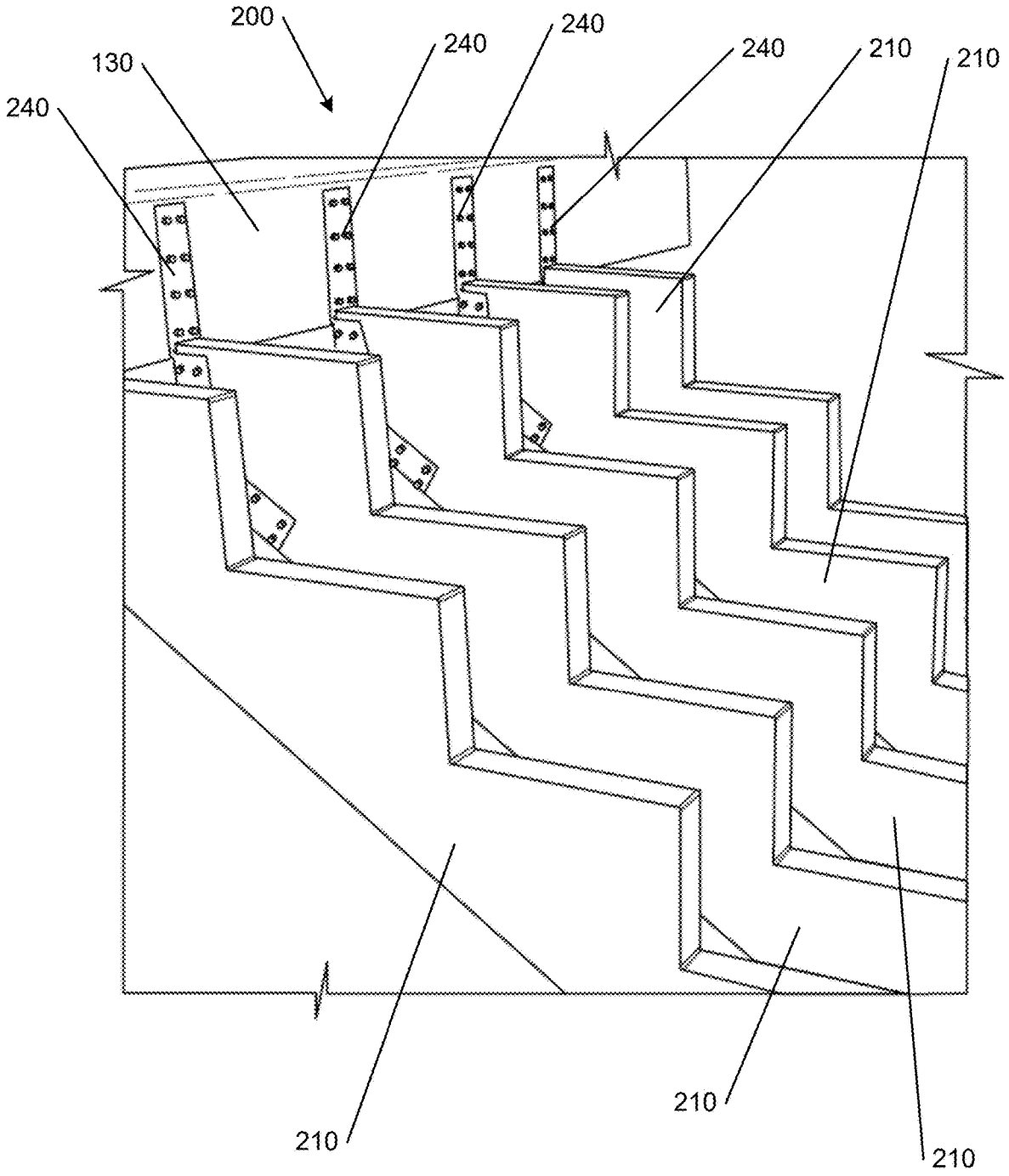
FIG. 7B is a side perspective view of an exemplary stair assembly from FIG. 7A according to one or more aspects described herein.

FIGS. 7A-8D depict a stair stringer 210 as part of the metal substructure framing system 100. FIGS. 7A-7C depict a plurality of stair stringers 210 assembled with metal substructure framing system 100. FIGS. 8A-8D depict an exemplary stair stringer 210 in various views. The stair stringers 210 may be full-length, trimmable, hollow, laser-cut metal stair stringers. The stair stringers 210 may be laser cut and bent to create the shape of the stringer with the rises and runs cut out. The rises and runs that the treads are attached to may be welded on to the stair stringers 210. The full-length stair stringer 210 may include a plurality of rises 212 and a plurality of runs 214. The plurality of rises 212 and the plurality of runs 214 may be separate pieces that are welded onto the full-length stair stringer 210. The runs 214 may be according to standard lengths, such as a 10½" run. Other length runs 214 may be provided without departing from the invention. The rises 212 of the stair stringer 210 may be customizable between distances and heights between approximately 6¾" to 7¼", for example, a stair stringer 210 with a 6¾" rise, a 6⅞" rise, a 7" rise, a 7⅛" rise, or a 7¼" rise.

Additionally, the length and number of rises/runs of the stair assembly 200 and the stair stringers 210 may be customizable. Each stair stringer 210 may be cut to any length and number of rises/runs as required for the metal substructure framing system 100. For example, a full-length stair stringer 210 may include sixteen steps or sixteen rises/runs. The stair stringer 210 may be customized and cut to include any number of steps and rises/runs less than sixteen.

Figure 8B:
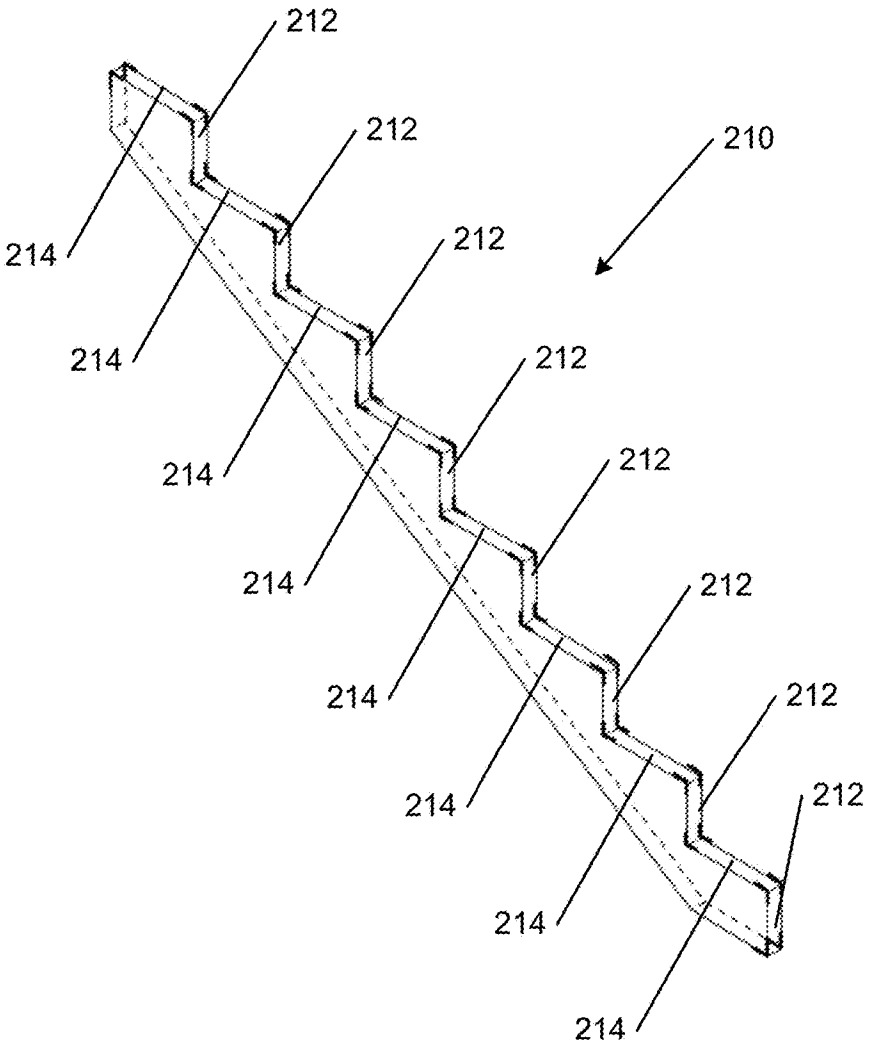
FIG. 8B is a side perspective view of the stair stringer from FIG. 8A according to one or more aspects described herein.
Figure 8A:
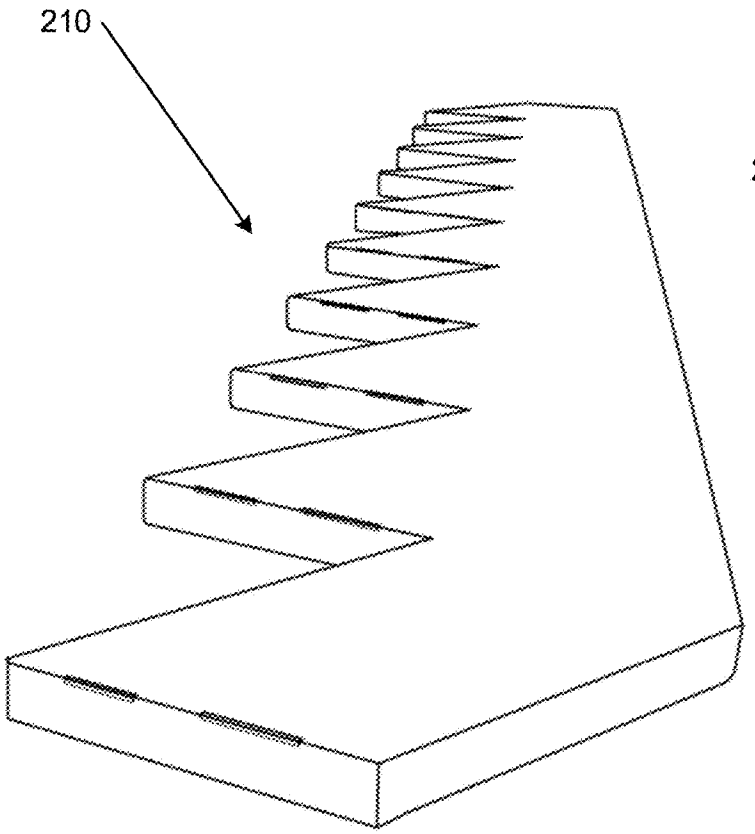
FIG. 8A is a top perspective view of an exemplary stair stringer according to one or more aspects described herein.
Figures 8C, 8D:
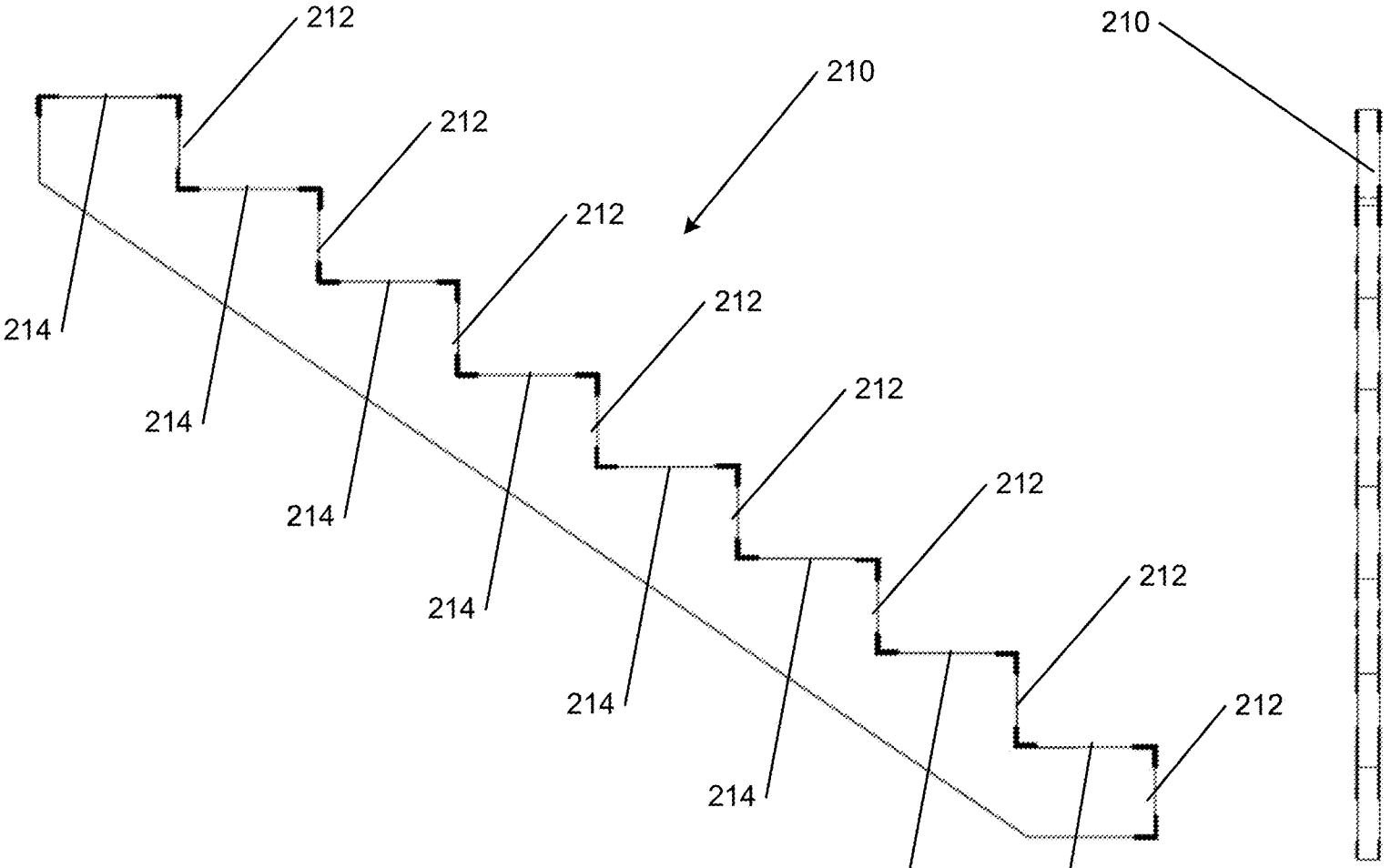
FIG. 8C is a side view of the stair stringer from FIG. 8A according to one or more aspects described herein.
FIG. 8D is a top view of the stair stringer from FIG. 8A according to one or more aspects described herein.
Figure 8E:
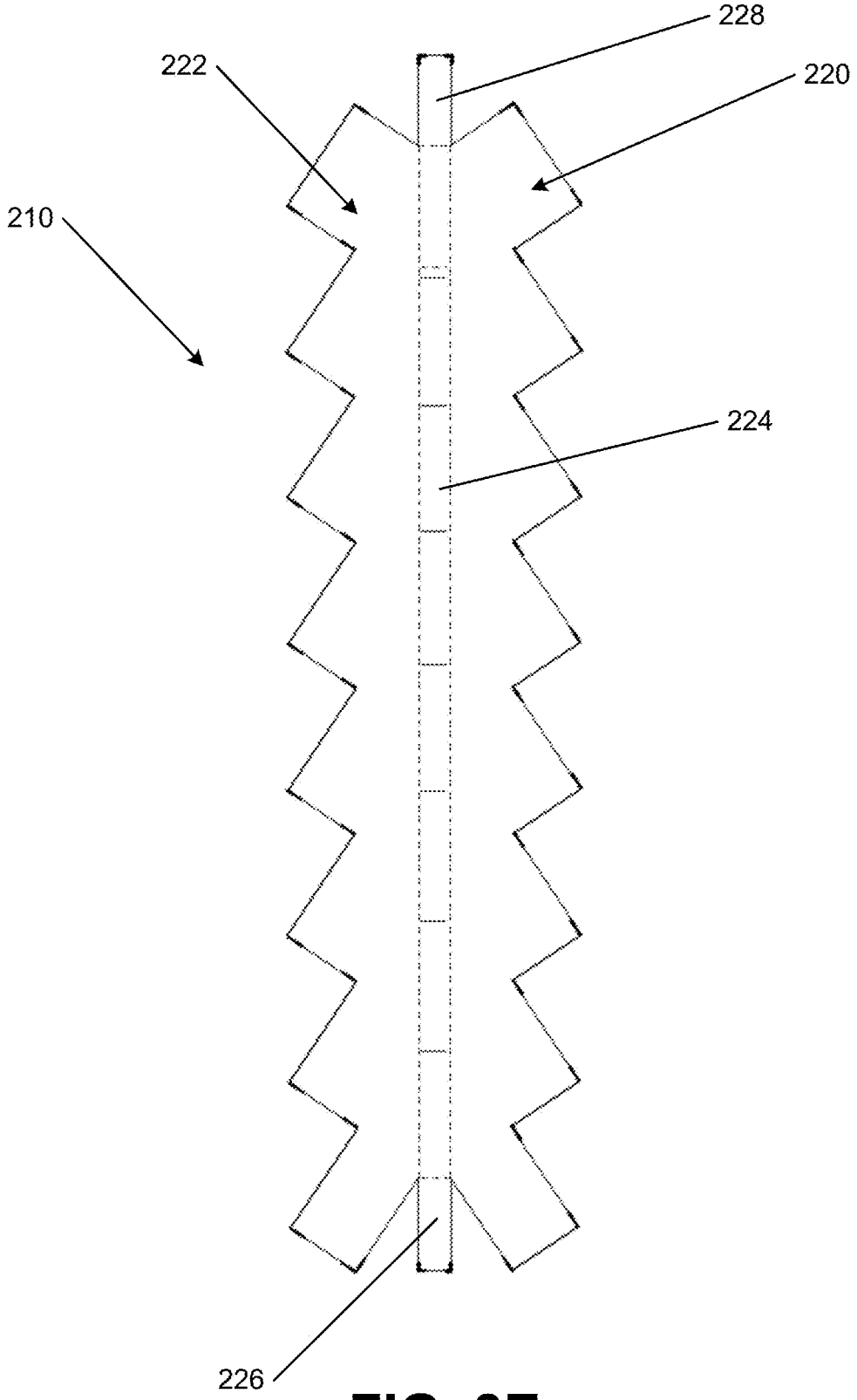
FIG. 8E is a top view of a prefabricated configuration of the stair stringer from FIG. 8A according to one or more aspects described herein.

The stair stringer 210 may be assembled by forming and bending a single laser-cut steel sheet, thereby creating a hollow stair stringer 210. FIG. 8E shows an exemplary stair stringer 210 prior to assembling, forming, and bending, in a single laser-cut steel sheet. As shown in FIG. 8E, the stair stringer 210 may include a first side panel 220, a second side panel 222, and a bottom panel 224 located between the first side panel 220 and the second side panel 222. The first side panel 220 and second side panel 222 may be mirror opposites of each other. The first side panel 220 and the second side panel 222 may fold and bend perpendicular to the bottom panel 224. The first side panel 220 may include the rises 212 that may be welded perpendicular to the first side panel 220 to form the rises 212 between the first side panel 220 and the second side panel 222. The second side panel 222 may include the runs 214 that may be welded perpendicular to the second side panel 222 to form the runs 214 between the first side panel 220 and the second side panel 222. The bottom panel 224 may also include a lower edge panel 226 that folds vertical to form the lower edge of the stair stringer 210. The bottom panel 224 may also include an upper edge panel 228 that folds vertical to form the upper edge of the stair stringer 210.

Figure 7C:
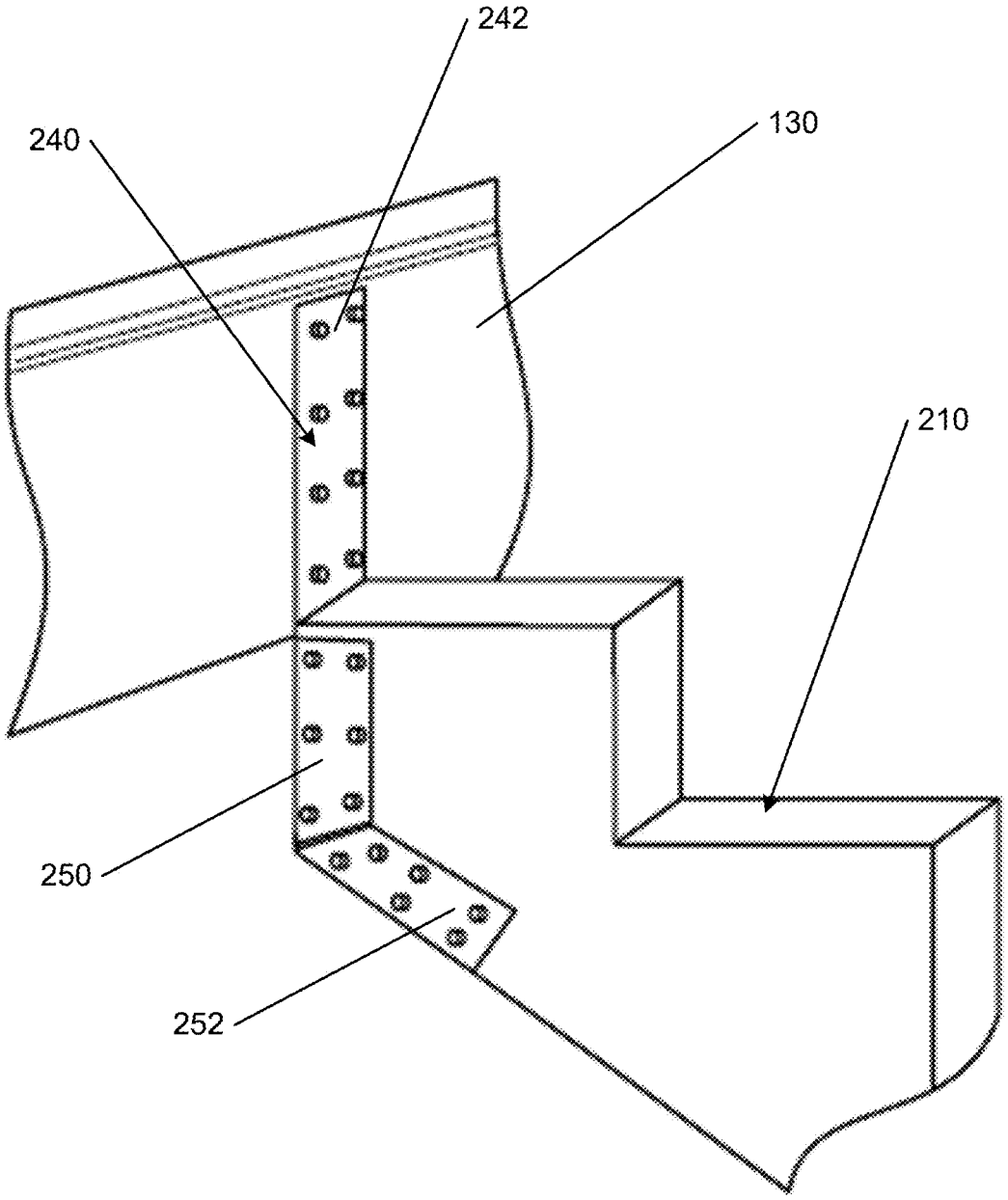
FIG. 7C is a detail view of an exemplary connection between a joist and a stair stringer using a stair stringer bracket according to one or more aspects described herein.

Each stair assembly 200 may include at least five stair stringers 210 spanning across the width of the stair assembly 200. The plurality of stair stringers 210 may span across and be evenly spread across the stair assembly 200. As shown in FIG. 7C, the stair assembly 200 may be attached to and fastened to the metal substructure framing system 100, and specifically to the tracks 120 or or the joists 130. Each stair stringer 210 of the stair assembly 200 may be attached to and/or connected to the tracks 120 or the joists 130 using a stair stringer bracket 240. The stair stringer bracket 240 attaches the stair stringer 210 to the metal substructure framing system 100 and specifically to the tracks 120 or the joists 130. The stair stringer bracket 240 attaches to both the first side panel 220 and the second side panel 222 of the stair stringer 210 with a wrapping bracket design.

Figure 9A:
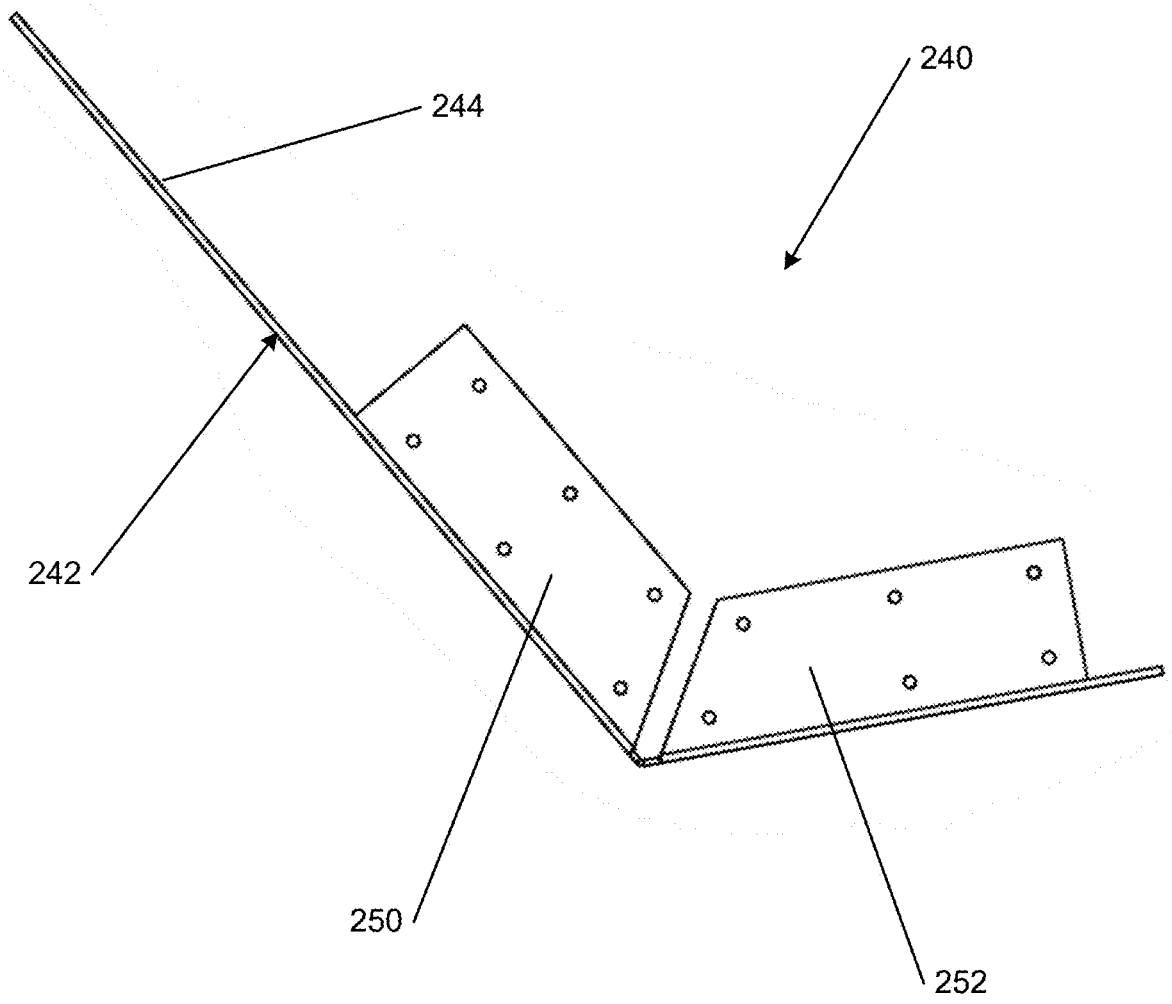
FIG. 9A is a side view of an exemplary stair stringer bracket in a bent and folded configuration according to one or more aspects described herein.
Figure 9B:
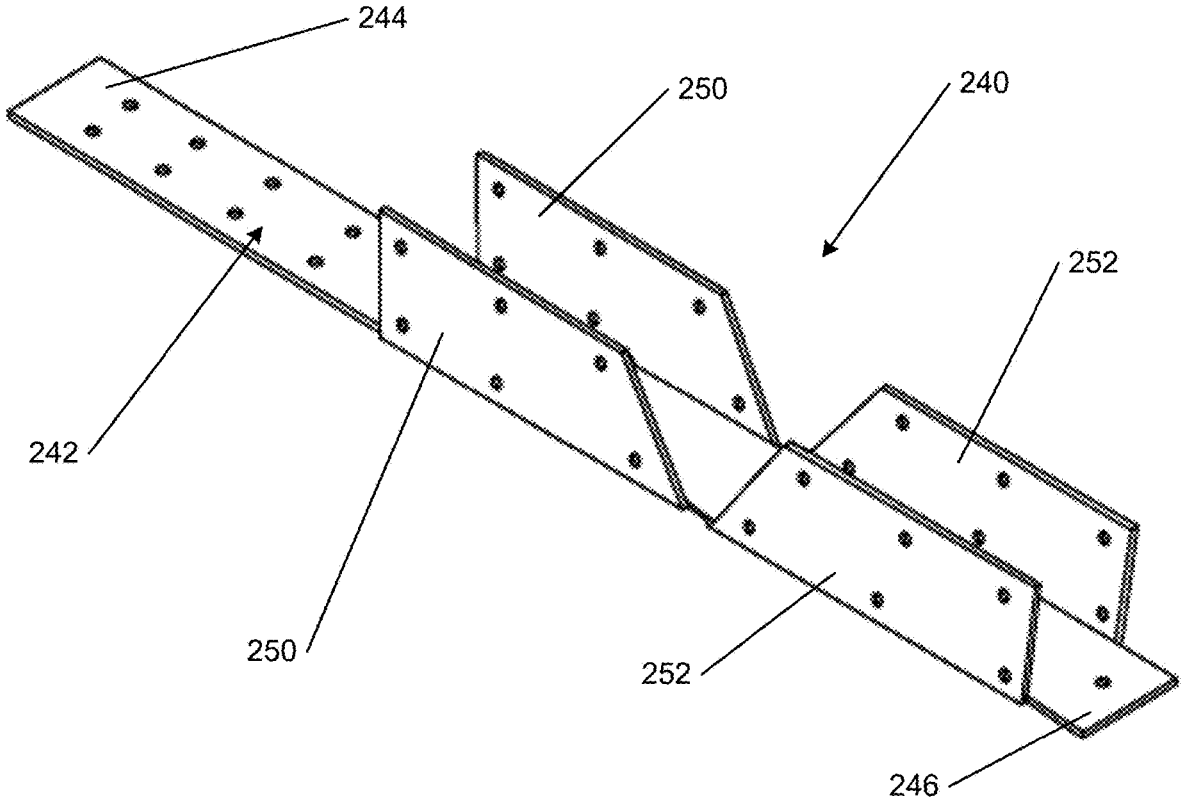
FIG. 9B is a top side perspective view of the stair stringer bracket in an unfolded configuration from FIG. 9A according to one or more aspects described herein.

FIGS. 9A-9E depict an exemplary stair stringer bracket 240 that attaches the stair stringer 210 to the metal substructure framing system 100. FIG. 9A depicts the stair stringer bracket 240 in the bent and folded configuration. FIGS. 9B-9E depict the stair stringer bracket 240 in the unfolded configuration. As shown in FIGS. 9A-9E, the stair stringer bracket 240 may include a base panel 242, a pair of mid-wing panels 250, and a pair of bottom wing panels 252. The base panel 242 may have a first end 244 that attaches to the metal substructure framing system 100 and specifically to the tracks 120 or the joists 130. The base panel 242 may also have a second end 246 opposite the first end 244. The pair of mid-wing panels 250 may extend perpendicular from the base panel 242 and located approximately in the middle of the stair stringer bracket 240 between the first end 244 and the second end 246. The pair of bottom wing panels 252 may extend perpendicular from the base panel 242 at approximately the second end 246 of the base panel 242.

The first end 244 of the base panel 242 may have a plurality of fastener holes 248 for a plurality of fasteners to fasten and attach the stair stringer bracket 240 to the metal substructure framing system 100 and specifically to the tracks 120 or the joists 130. The plurality of fastener holes 248 may include various numbers of holes, such as between four and sixteen holes, without departing from the invention. In a preferred embodiment, the first end 244 of the base panel may include thirteen fastener holes 248.

Each of the of mid-wing panels 250 and the of bottom wing panels 252 may have a plurality of fastener holes 254 for a plurality of fasteners to fasten and attach the stair stringer bracket 240 to the stair stringer 210. The plurality of fasteners holes 254 may include various numbers of holes, such as between four and ten holes, without departing from the invention. In a preferred embodiment, each of the mid-wing panels 250 and the bottom wing panels 252 may include six fasteners holes 254.

In addition, the stair stringer bracket 240 may be formed by bending a single laser-cut steel sheet, thereby creating a stair stringer bracket 240. Each of the mid-wing panels 250 and bottom wing panels 252 may be bent perpendicular to the base panel 242, thereby creating the stair stringer bracket 240.

Figure 10A:
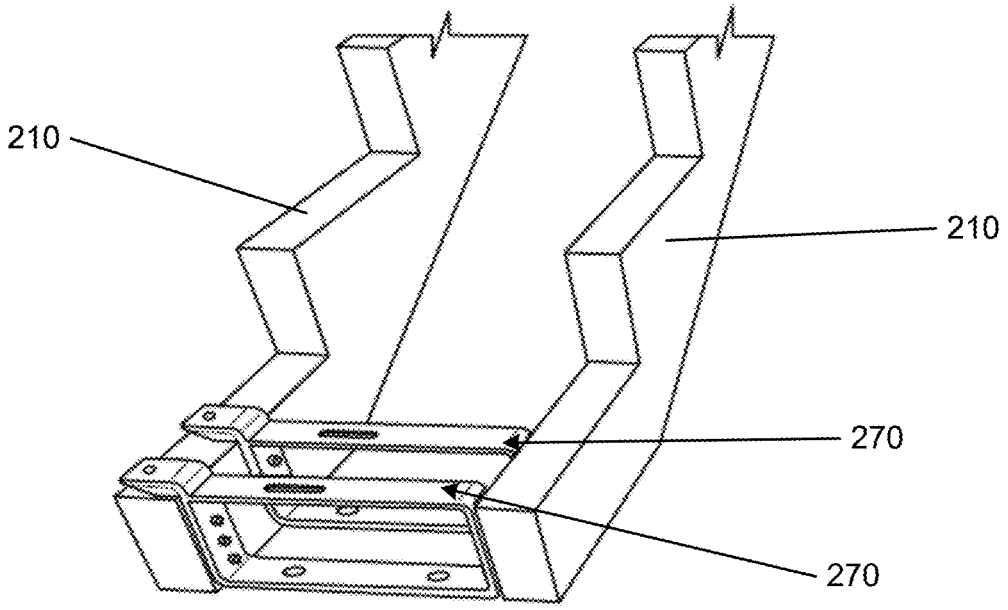
FIG. 10A is a top perspective view of exemplary stair stringer handrail post brackets installed on stair stringers according to one or more aspects described herein.
Figure 10B:
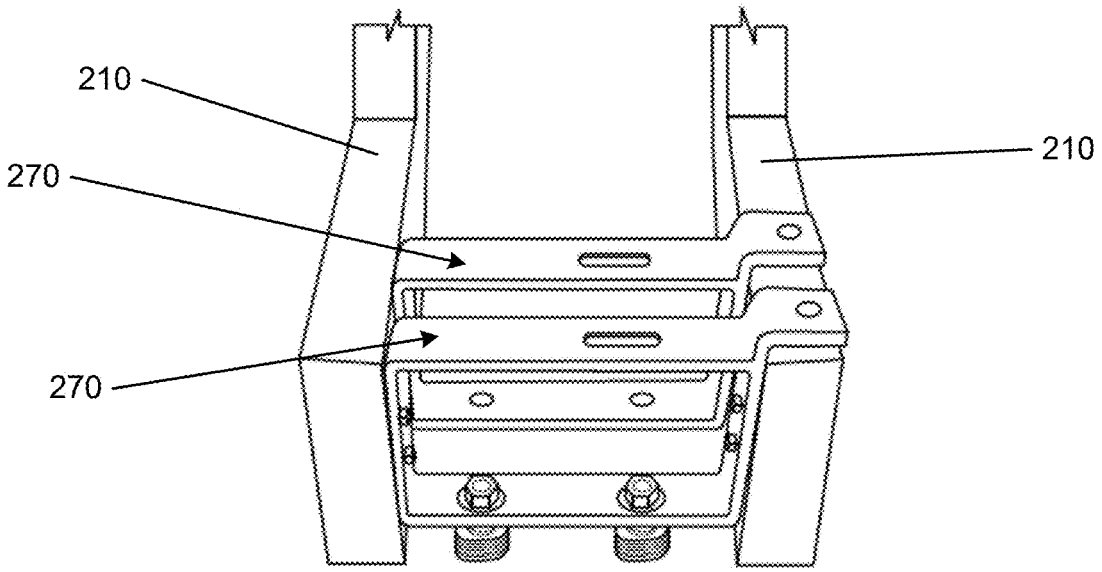
FIG. 10B is a front perspective view of the stair stringer handrail post brackets from FIG. 10A according to one or more aspects described herein.
Figure 11A:
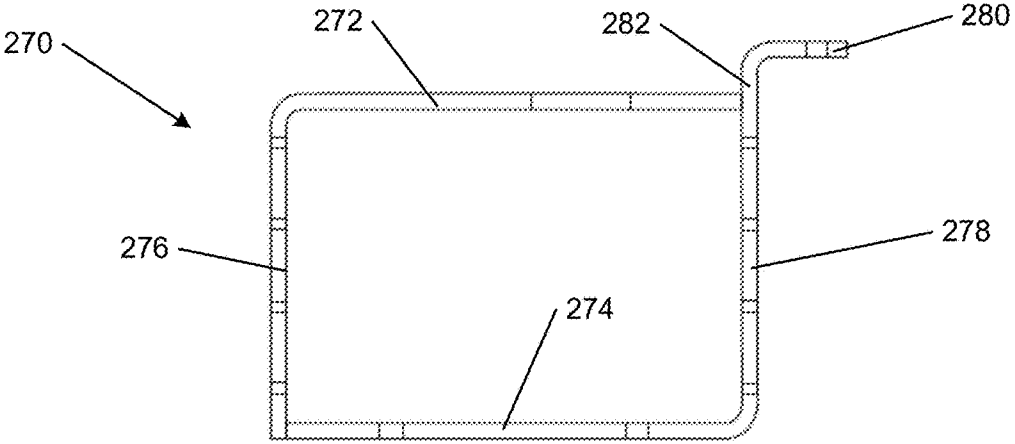
FIG. 11A is a side view of the stair stringer handrail post bracket from FIG. 10A according to one or more aspects described herein.
Figure 11B:
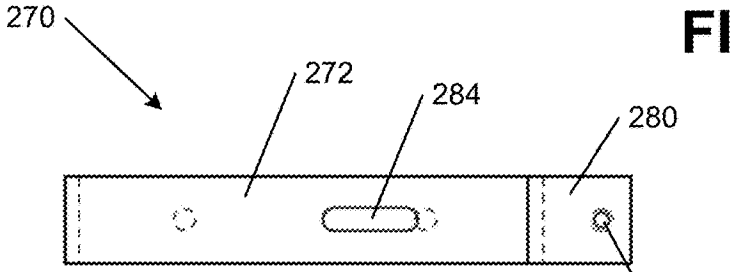
FIG. 11B is a top view of the stair stringer handrail post bracket from FIG. 10A according to one or more aspects described herein.
Figure 11C:
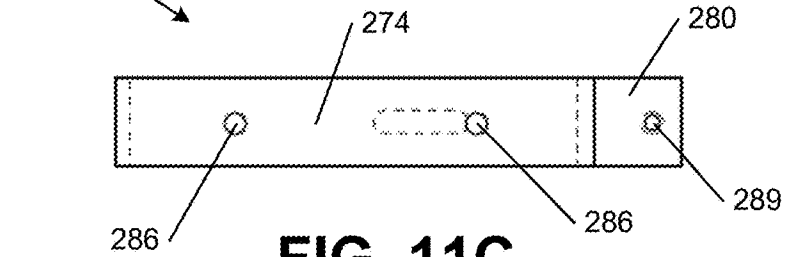
FIG. 11C is a bottom view of the stair stringer handrail post bracket from FIG. 10A according to one or more aspects described herein.
Figures 11D, 11E:
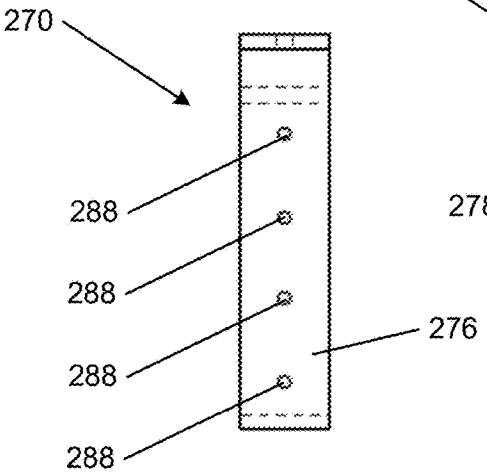
FIGS. 11D and 11E are end views of the stair stringer handrail post bracket from FIG. 10A according to one or more aspects described herein.
Figure 12:
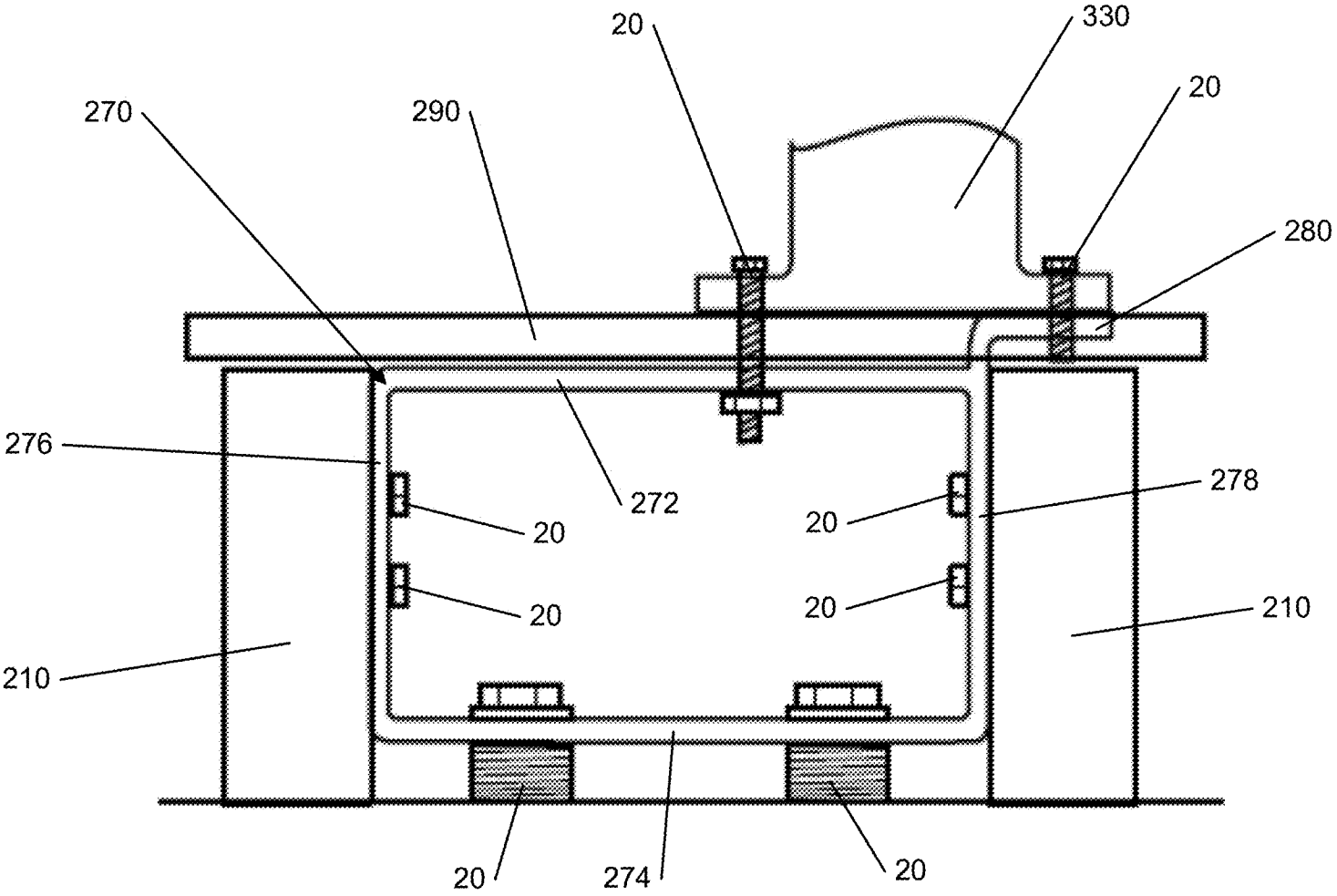
FIG. 12 is a side cross-sectional view of an exemplary stair stringer handrail post bracket installed on stair stringers with a handrail post or a post base according to one or more aspects described herein.

FIGS. 10A-12 depict a stair stringer handrail post brackets 270 as part of the stair assembly 200 and the metal substructure framing system 100. FIGS. 10A and 10B depict a pair of stair stringer handrail post brackets 270 assembled on two stair stringers 210 with metal substructure framing system 100. FIGS. 11A-11E depict an exemplary stair stringer handrail post brackets 270 in various views. FIG. 12 depicts exemplary stair stringer handrail post brackets 270 assembled with two adjacent stair stringers 210 with a handrail post or handrail post base attached to the stair stringer handrail post brackets 270. The stair stringer handrail post brackets 270 may fit in between and attach to two different adjacent stair stringers 210 to connect to a handrail post on the stair assembly 200. The stair stringer handrail post brackets 270 may be adjustable and fit all size handrails and handrail bases, using the slots 284 on the top of the stair stringer handrail post brackets 270.

FIGS. 11A-11E depict an exemplary stair stringer handrail post bracket 270 used to attach a handrail post to an outermost stair stringer 210. FIG. 11A depicts a plane view of the stair stringer handrail post bracket 270. FIG. 11B depicts a top view of the stair stringer handrail post bracket 270. FIG. 11C depicts a bottom view of the stair stringer handrail post bracket 270. FIGS. 11D and 11E depict side views of the stair stringer handrail post bracket 270. As shown in FIGS. 11A-11E, the stair stringer handrail post bracket 270 may include a top bar 272, a bottom bar 274, and two side bars 276, 278 located on opposite sides of the stair stringer handrail post bracket 270. The top bar 272, the bottom bar 274, and two side bars 276, 278 may create an open rectangular bracket configured to attach to two adjacent stair stringers 210 and a handrail post or a post base. The stair stringer handrail post bracket 270 may include a post tab 280 that extends laterally from the stair stringer handrail post bracket 270. The post tab 280 may extend laterally with a vertical offset 282 from the top bar 272.

The top bar 272 of the stair stringer handrail post bracket 270 may include one or more slots 284 located horizontally on the top bar 272. The slot 284 may be configured to receive a fastener 20 to slide through the slot 284 and attach to a handrail post or a post base to the stair stringer 210. The slot 284 may be oval in shape or circular in shape. The fastener 20 may attach the corner of a handrail post or a post base through the slot 284 of the stair stringer handrail post bracket 270 to the stair stringer 210. The slot 284 creates the adjustability of the stair stringer handrail post bracket 270 allowing various sizes and types of handrail posts or post bases.

The bottom bar 274 of the stair stringer handrail post bracket 270 may be parallel to the top bar 272. The bottom bar 274 may include one or more fastener holes 286. The one or more fastener holes 286 on the bottom bar 274 may be configured to receive fasteners 20 to attach the stair stringer handrail post bracket 270 to the ground. As shown in FIG. 11C, the bottom bar 274 may include two fastener holes 286. The bottom bar 274 may include other numbers of fastener holes 286 without departing from the invention.

The side bars 276, 278 of the stair stringer handrail post bracket 270 may be perpendicular to the top bar 272 and the bottom bar 274. The side bars 276, 278 may include one or more fastener holes 288. The one or more fastener holes 288 on the side bars 276, 278 may be configured to receive fasteners 20 to attach the stair stringer handrail post bracket 270 to each of the adjacent stair stringers 210 that the stair stringer handrail post bracket 270 is positioned between. As shown in FIGS. 11D and 11E, the side bars 276, 278 may include three fastener holes 288. The bottom bar 274 may include other numbers of fastener holes 286 without departing from the invention.

The post tab 280 of the stair stringer handrail post bracket 270 may extend laterally from the handrail post bracket 270 laterally from the top bar 272. The post tab 280 may extend laterally with a vertical offset 282 from the top bar 272. The post tab 280 may include one or more fastener holes 289. The fastener hole 289 on the post tab 280 may be configured to receive a fastener 20 to attach the stair stringer handrail post bracket 270 to a handrail post or a post base and to the stair stringer 210. The fastener 20 may attach the corner of a handrail post or a deck base 330 through the fastener hole 289 on the post tab 280 of the stair stringer handrail post bracket 270 to the stair stringer 210.

The stair assembly 200 and the components of the stair assembly 200, to include the stair stringers 210, the stair stringer brackets 240, and the stair stringer handrail post brackets 270 may be made of a light gauge steel framing that may be used for outdoor use. The stair assembly 200 may be made of cold-formed steel components. The stair assembly 200 may provide a durable material, such as a triple-coated steel material. The triple-coated steel material may be a 14-gauge G60 galvanized steel that is powder-coated or other gauges without departing from the invention. The triple-coated material may provide superior durability with three layers of protection surrounding a carbon steel core, with a first layer with a hot-dipped galvanized coating next to the carbon steel core, a second layer with a baked-on prime coat next to the second layer, and a third exterior layer with a baked-on exterior with high-performance polyester coating. The triple-coated material may ensure the stair assembly 200 holds up to the exterior elements for decades. The stair assembly 200 may also include and provide a safe, non-combustible, rot-proof, and termite-proof material. The stair assembly 200 may also provide a sustainable material, utilizing at least 25% recycled steel, that is 100% recyclable. The stair assembly 200 may also be code-listed for exterior use.

FIGS. 13-15B depict a handrail post attachment block system 300 as part of the metal substructure framing system 100. The handrail post attachment block system 300 may include one or more blocks 310. In an exemplary embodiment, the handrail post attachment block system 300 may include three or four blocks 310 forming a square or rectangle attachment base 320, with each of the three or four blocks 310 forming a side of the square or rectangular attachment base 320. The one or more blocks 310 may be high-density poly-ethylene (HDPE) molded "lumber" blocks. The one or more blocks 310 may be other strong plastic materials, or materials with similar properties, without departing from this invention. The handrail post attachment block system 300 and the one or more blocks 310 may create a durable and strong attachment base 320 for the handrail or deck posts within the metal substructure framing system 100.

Figure 13:
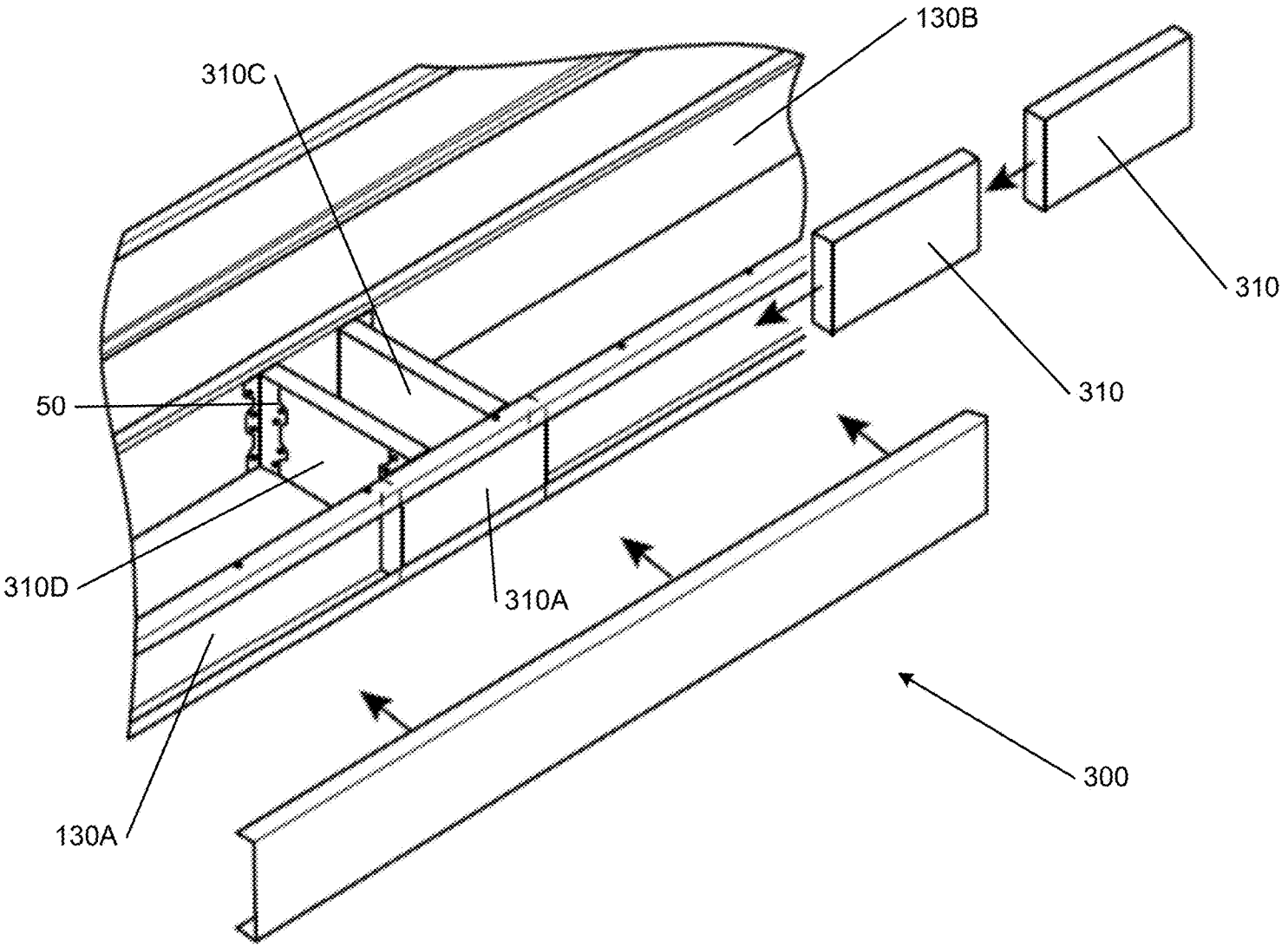
FIG. 13 is a perspective view of an exemplary handrail post attachment block system installed on a non-corner location of the metal substructure framing system according to one or more aspects described herein.
Figure 15A:
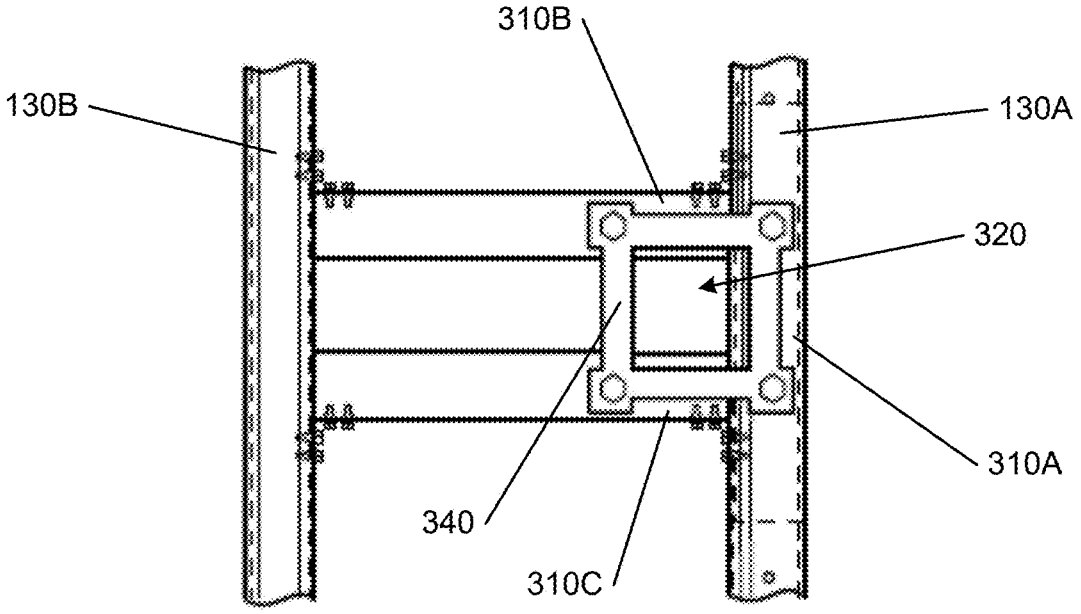
FIG. 15A is a top view of an exemplary handrail or deck post base for attaching the handrail or deck post attached to a non-corner position handrail post attachment block system according to one or more aspects described herein.

FIG. 13 depicts the handrail post attachment block system 300 installed on a non-corner location of the metal substructure framing system 100 with a first block 310A sliding into the hollow rectangular cross-section of a first joist 130A. The first block 310A may also slide into the hollow rectangular cross-section of a ledger track 110, without departing from the invention. Additionally, one of the sides of the first joist 130A may removed and replaced to slide and move the first block 310A into position. Additionally, a second block 310B and a third block 310C may be set perpendicular to the first block 310A. The second block 310B and the third block 310C may be attached to and span between the first joist 130A and the second joist 130B. The second block 310B and the third block 310C may be attached to the first joist 130A and the second joist 130B using brackets 50 or other fastening or attaching means. The second block 310B and the third block 310C may form the rectangle attachment base 320 with the first block 310A to attach to the handrail or deck posts 330. FIG. 15A depicts an exemplary handrail or deck post base 340 for attaching the handrail or deck post 330 attached to a non-corner position handrail post attachment block system 300 as described above.

Figure 14A:
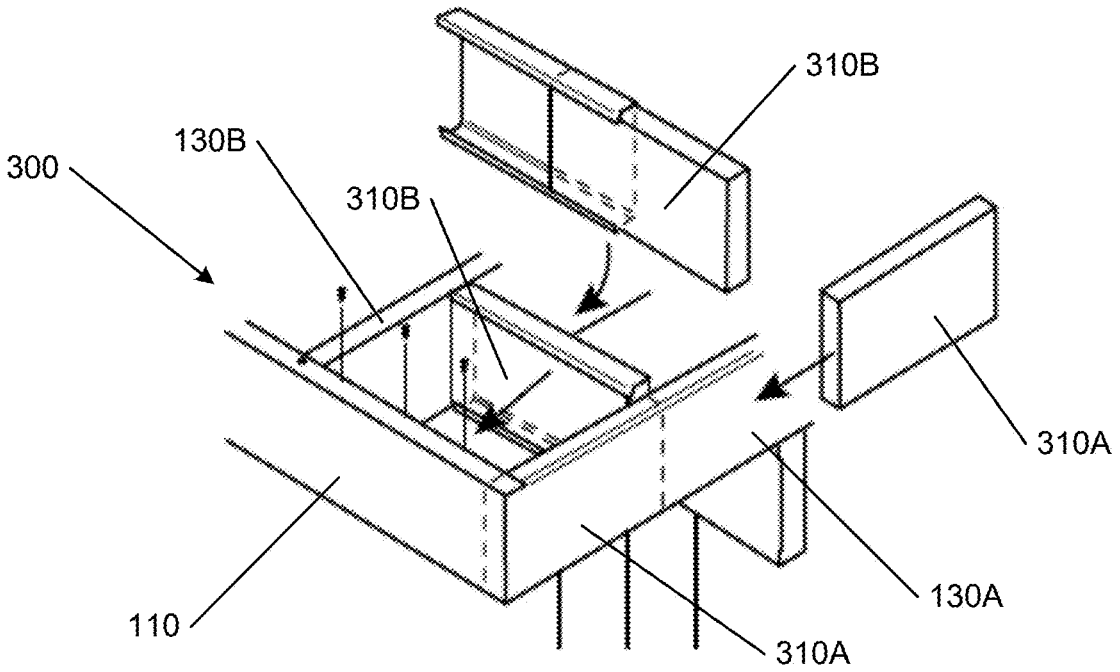
FIGS. 14A and 14B are perspective views of an exemplary handrail post attachment block system installed on a corner location of the metal substructure framing system according to one or more aspects described herein.
Figure 14B:
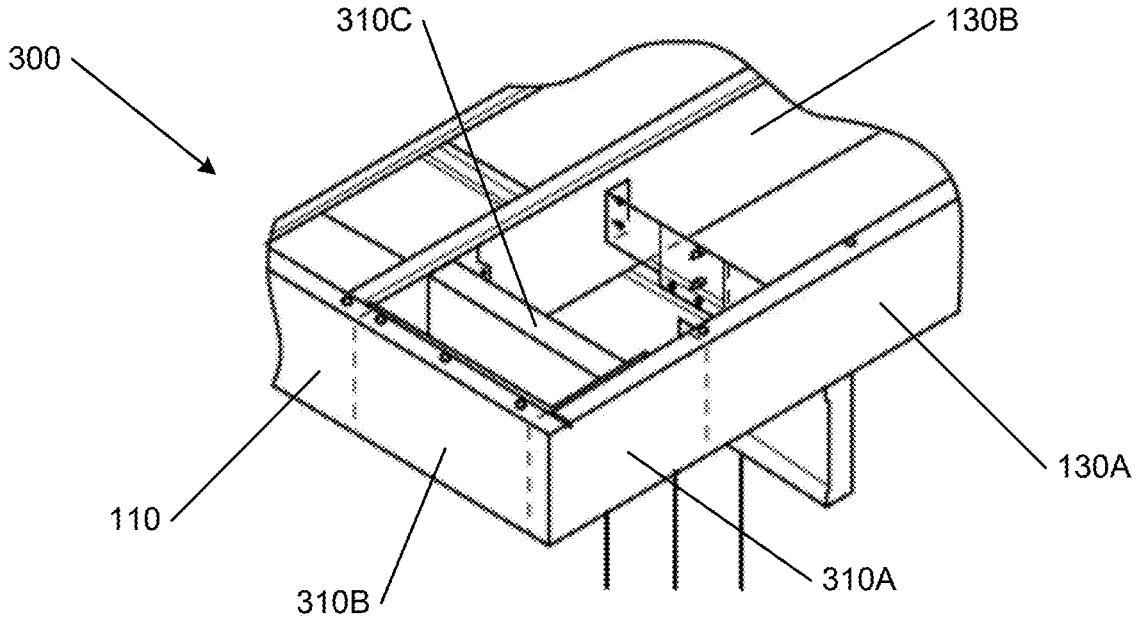
Figure 15B:
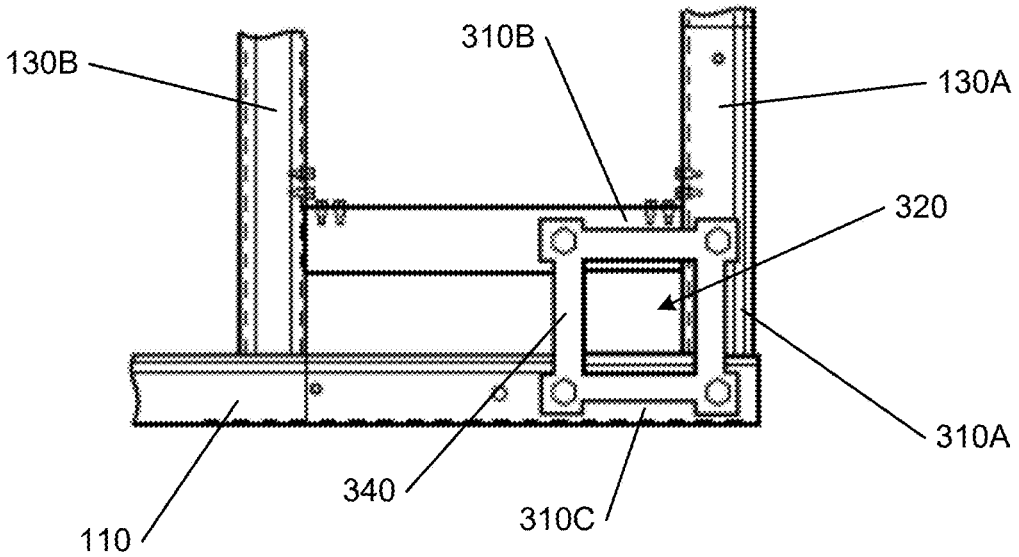
FIG. 15B is a top view of an exemplary handrail or deck post base for attaching the handrail or deck post attached to a corner position handrail post attachment block system according to one or more aspects described herein.

FIGS. 14A and 14B depict the handrail post attachment block system 300 installed on a corner location of the metal substructure framing system 100 with a first block 310A sliding into the hollow rectangular cross-section of a first joist 130A located on an external side of the deck. The first block 310A may slide into the end of the first joist 130A where the joist meets the ledger track 110. A second block 310B may slide into position within the hollow rectangular cross section of the ledger track 110 adjacent to the first joist 130A. The second block 310B may be perpendicular to and adjacent to the first block 310A. Additionally, a third block 310C may be set perpendicular to the first block 310A and parallel to the second block 310B between the first joist 130A and a second joist 130B. The third block 310C may be attached to and span between the first joist 130A and the second joist 130B. The third block 310C may be attached to the first joist 130A and the second joist 130B using brackets 50 or other fastening or attaching means. The second block 310B and the third block 310C may form the rectangle attachment base 320 with the first block 310A to attach to the handrail or deck posts 330. FIG. 15B depicts an exemplary handrail or deck post base 340 for attaching the handrail or deck post 330 attached to a corner position handrail post attachment block system 300 as described above.

Figure 16A:
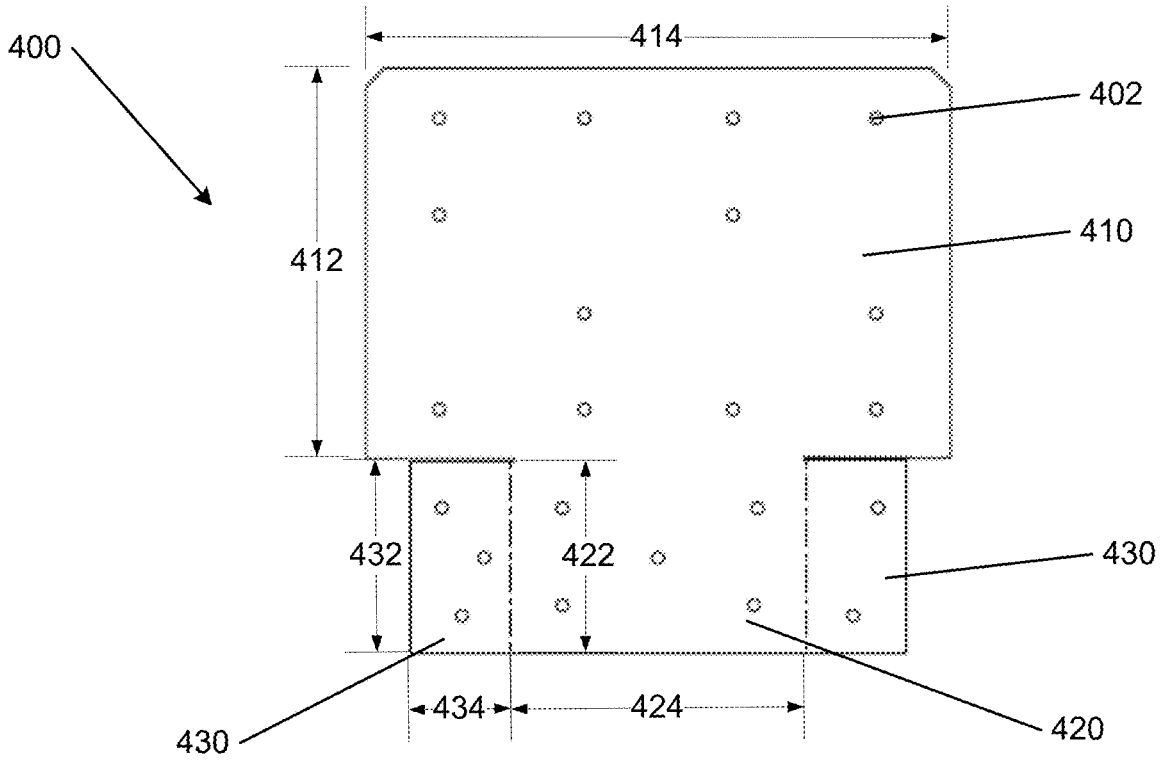
FIG. 16A is side view of an exemplary front post bracket as part of the metal substructure framing system according to one or more aspects described herein.
Figure 16B:
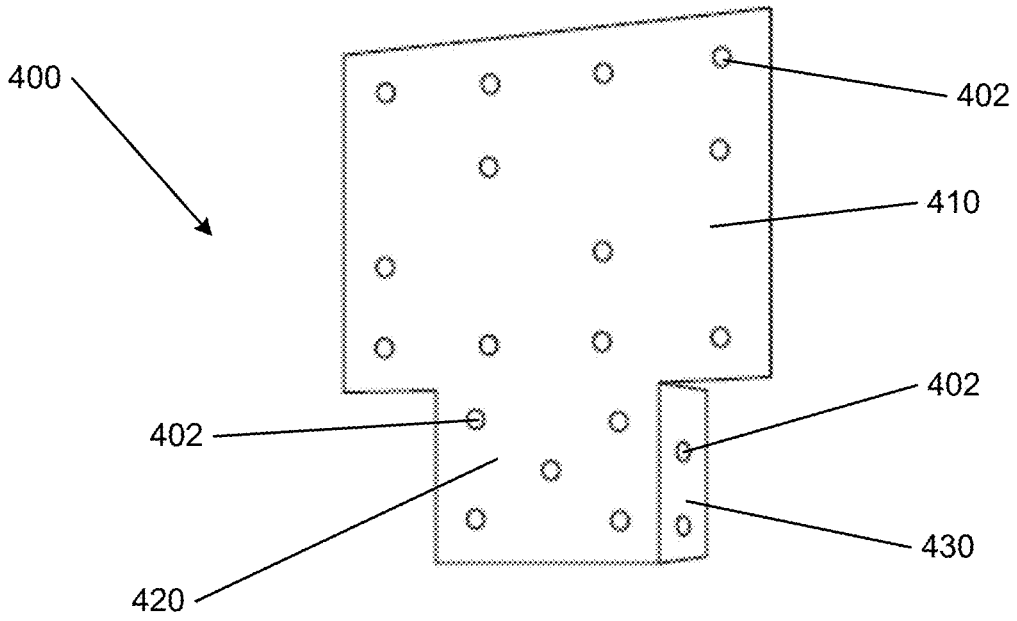
FIG. 16B is a side perspective view of the front post bracket from FIG. 16A according to one or more aspects described herein.
Figure 18A:
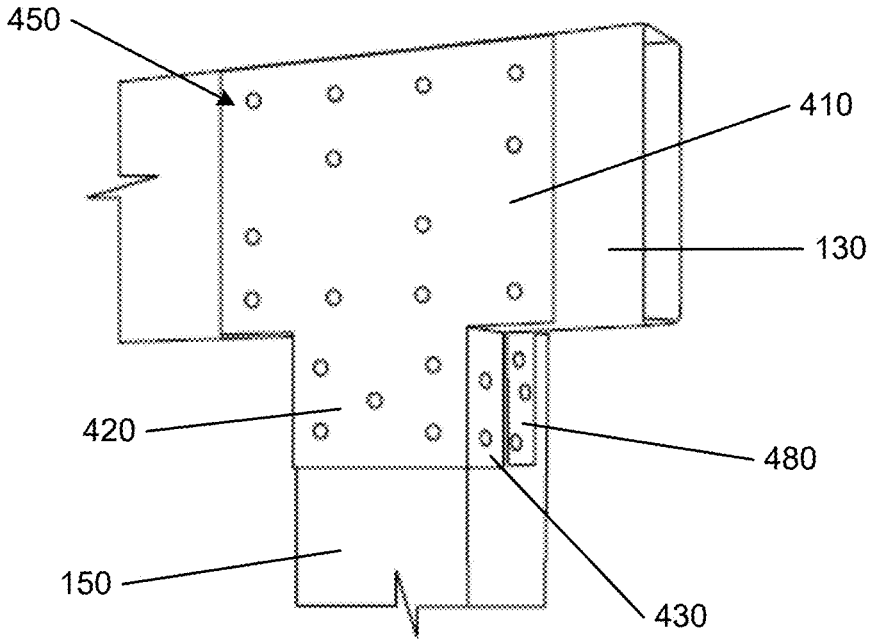
FIG. 18A is a front perspective view of an exemplary front post bracket and rear post bracket installed on a joist and support post according to one or more aspects described herein.
Figure 18B:
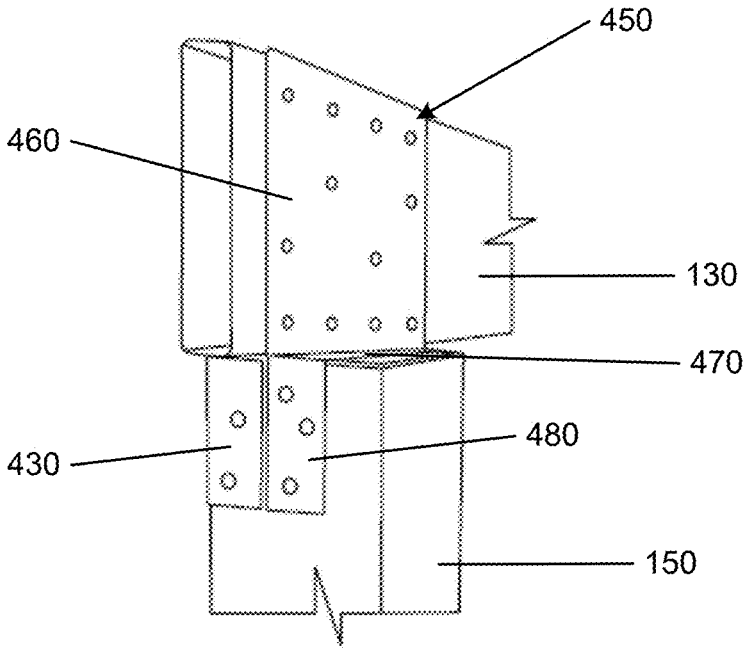
FIG. 18B is a rear perspective view of the front post bracket and rear post bracket installed on a joist and support post from FIG. 18A according to one or more aspects described herein.

FIGS. 16A and 16B depict a front post bracket 400 and 17A and 17B depict a rear post bracket 450 as part of the metal substructure framing system 100. The front post bracket 400 and the rear post bracket 450 proved a lateral attachment for the support posts 150. The front post bracket 400 and the rear post bracket 450 create lateral support and sway protection to the metal substructure framing system 100. The front post bracket 400 and/or the rear post bracket 450 may be installed when attaching a ledger track 110 or a joist 130 to a support post 150. FIGS. 18A and 18B show the front post bracket 400 and the rear post bracket 450 attached to the joist 130 and the support post 150, with FIG. 18A showing the front view and the front post bracket 400 and FIG. 18B showing the rear view and the rear post bracket 450. The front post bracket 400 may be installed on a front of a joist 130 or ledger track 110 when attaching to the support post 150. The rear post bracket 450 may be installed on a rear of a joist 130 or ledger track 110 when attaching to the support post 150.

FIGS. 16A and 16B depict a front post bracket 400 that can be attached to a ledger track 110 or a joist 130 and a support post 150. As shown in FIGS. 16A and 16B, the front post bracket 400 may include a rectangular shaped base 410, a post support portion 420, and one or two post support wings 430 that extend and bend from the post support portion 420.

The base 410 of the front post bracket 400 may be rectangular-shaped and include a height 412 equivalent to the width of the ledger tracks 110 and joists 130, such as for example, eight inches. The base 410 may also include a width 414 that extends greater than the width of the support post 150, such as for example, twelve inches. The base 410 may include a plurality of fastener holes 402 to attach the base 410 to the ledger tracks 110 and joists 130. The base 410 may include between four and twenty fastener holes, or for example, may include twelve fastener holes 402. The base 410 may include other heights 412 and widths 414 without departing from this invention. The base 410 may be other shapes without departing from this invention.

The post support portion 420 of the front post bracket 400 may extend from the base 410 and also be rectangular-shaped. The post support portion 420 may include a height 422 that provides adequate lateral support and sway protection to the connection between the ledger tracks 110 and the joists 130 and the support posts 150, such as for example, four inches. The post support portion 420 may also include a width 424 that is equivalent to the width of the support post 150, such as for example, six inches. The post support portion 420 may include a plurality of fastener holes 402 to attach the post support portion 420 to the support post 150. The post support portion 420 may include between two and ten fastener holes, or for example, may include five fastener holes 402. The post support portion 420 may include other heights 422 and widths 424 without departing from this invention. The post support portion 420 may be other shapes without departing from this invention.

The post support wings 430 of the front post bracket 400 may extend from the post support portion 420 and also be rectangular-shaped. The post support wings 430 may bend from the sides of the post support portion 420 and downward along the support post 150. The post support wings 430 may include a height 432 that provides adequate lateral support and sway protection to the connection between the ledger tracks 110 and the joists 130 and the support posts 150, such as for example, four inches. The height 432 of the post support wings 430 may be equivalent to the height 422 of the post support portion 420. The post support wings 430 may also include a width 434 that is equivalent to the thickness of the ledger tracks 110 and the joists 130, such as for example, two inches. The post support wings 430 may include a plurality of fastener holes 402 to attach the post support wings 430 to the support post 150. The post support wings 430 may include between one and eight fastener holes, or for example, may include two or three fastener holes 402. The post support wings 430 may include other heights 432 and widths 434 without departing from this invention. The post support wings 430 may be other shapes without departing from this invention.

Figure 17A:
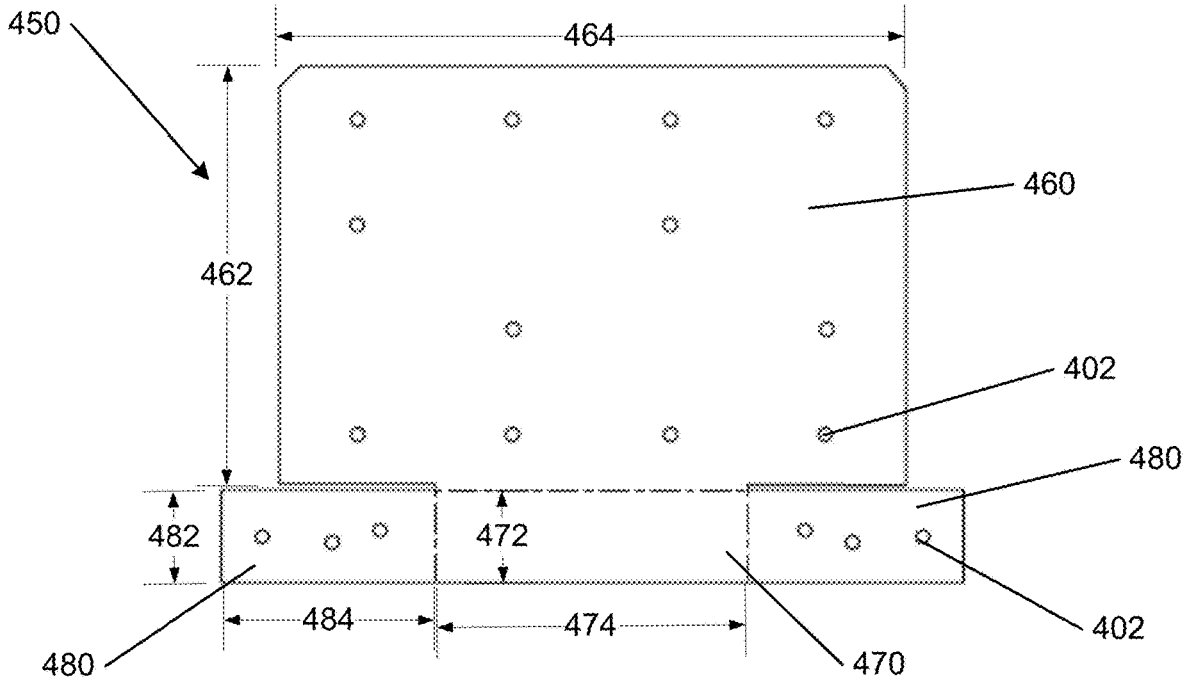
FIG. 17A is a side view of exemplary rear post bracket as part of the metal substructure framing system according to one or more aspects described herein.
Figure 17B:
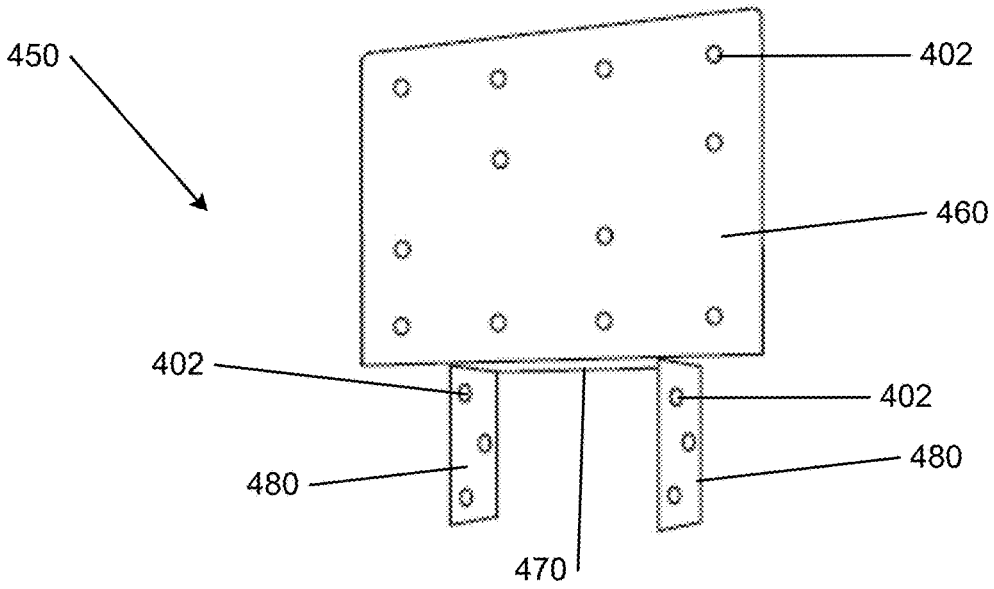
FIG. 17B is a side perspective view of the rear post bracket from FIG. 17A according to one or more aspects described herein.

FIGS. 17A and 17B depict a rear post bracket 450 that can be attached to a ledger track 110 or a joist 130 and a support post 150. As shown in FIGS. 17A and 17B, the front post bracket 400 may include a rectangular shaped base 460, a post support portion 470 that extends from and bends from the base 460, and one or two post support wings 480 that extend and bend from the post support portion 470.

The base 460 of the rear post bracket 450 may be rectangular-shaped and include a height 462 equivalent to the width of the ledger tracks 110 and joists 130, such as for example, eight inches. The base 460 may also include a width 464 that extends greater than the width of the support post 150, such as for example, twelve inches. The base 460 may include a plurality of fastener holes 402 to attach the base 460 to the ledger tracks 110 and joists 130. The base 460 may include between four and twenty fastener holes, or for example, may include twelve fastener holes 402. The base 460 may include other heights 462 and widths 464 without departing from this invention. The base 460 may be other shapes without departing from this invention.

The post support portion 470 of the rear post bracket 450 may extend from the base 460 and also be rectangular-shaped. The post support portion 470 may also bend from the base 460, such that it sets on the top portion of the support post 150, as shown in FIG. 17B. The post support portion 470 may include a height 472 that provides adequate lateral support and sway protection to the connection between the ledger tracks 110 and the joists 130 and the support posts 150, such as for example, two inches. The post support portion 470 may also include a width 474 that is equivalent to the width of the support post 150, such as for example, six inches. The post support portion 470 may or may not include a plurality of fastener holes 402 to attach the post support portion 470 to the support post 150. The post support portion 470 may include other heights 472 and widths 474 without departing from this invention. The post support portion 470 may be other shapes without departing from this invention.

The post support wings 480 of the rear post bracket 450 may extend from the post support portion 470 and also be rectangular-shaped. The post support wings 480 may bend from the sides of the post support portion 470 and downward along the support post 150. The post support wings 480 may include a height 482 that is equivalent to the thickness of the ledger tracks 110 and the joists 130, such as for example, two inches. The post support wings 480 may also include a width 484 that provides adequate lateral support and sway protection to the connection between the ledger tracks 110 and the joists 130 and the support posts 150, such as for example, four inches. The post support wings 480 may include a plurality of fastener holes 402 to attach the post support wings 480 to the support post 150. The post support wings 480 may include between one and eight fastener holes, or for example, may include three fastener holes 402. The post support wings 480 may include other heights 482 and widths 484 without departing from this invention. The post support wings 480 may be other shapes without departing from this invention.

The front post bracket 400 and the rear post bracket 450 may be made of various materials. For example, the front post bracket 400 and the rear post bracket 450 may be made of a light gauge steel framing that may be used for outdoor use. The front post bracket 400 and the rear post bracket 450 may be made of cold-formed steel components. The front post bracket 400 and the rear post bracket 450 may provide a durable material, such as a triple-coated steel material. The triple-coated steel material may be a 14-gauge G60 galvanized steel that is powder-coated or other gauges without departing from the invention. FIG. 6 shows an exemplary triple-coated material 102 for the front post bracket 400 and the rear post bracket 450. The front post bracket 400 and the rear post bracket 450 may also include and provide a safe, non-combustible, rot-proof, and termite-proof material. The front post bracket 400 and the rear post bracket 450 may also provide a sustainable material, utilizing at least 25% recycled steel, that is 100% recyclable. The front post bracket 400 and the rear post bracket 450 may also be code-listed for exterior use.

Figure 19:
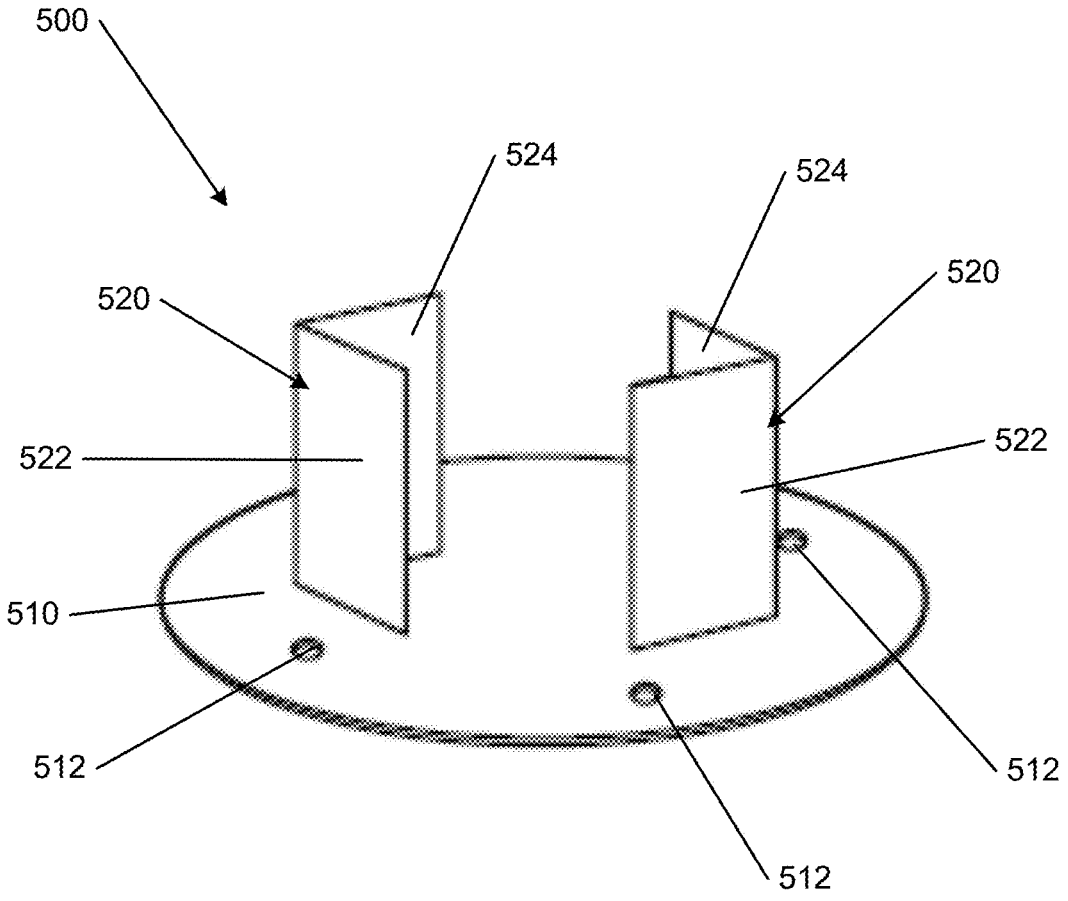
FIG. 19 is a perspective view of an exemplary post base to install and secure support posts as part of the metal substructure framing system according to one or more aspects described herein.

FIGS. 19 and 20A-20C depict a post base 500 that may be utilized to install and secure support posts 150 as part of the metal substructure framing system 100. The post base 500 provides lateral attachment for the support posts 150 and creates lateral support and sway protection for the metal substructure framing system 100. The post base 500, as depicted in FIG. 19, may include a footing base 510 and one or more vertical supports 520 extending perpendicular to the footing base 510. The footing base 510 may be circular, as shown in the exemplary embodiment, or other shapes, such as square, rectangular, or others without departing from this invention. The footing base 510 may also include a plurality of fastener holes 512 for attaching the footing base 510 to a footing 30, such as four fastener holes. The one or more vertical supports 520 may attach to the support post 150 when the support post 150 is slide over the vertical supports 520. The vertical supports 520, as shown in the exemplary embodiment, may be V-shaped to match the corners of the support post 150. The vertical supports 520 may be other shapes without departing from the invention. Additionally, as shown in the exemplary embodiment, the post base 500 may include two vertical supports 520 extending from the circular base 510. The post base 500 may include various other numbers of vertical supports 520, such as one, two, three, four, or more vertical supports 520. The vertical support 520, as shown in FIG. 18, may include a first side 522 and a second side 524 extending 90 degrees and perpendicular to the first side 522. Each of the first side 522 and the second side 524 of the vertical support 520 may line up and cooperate with one of the sides of the support post 150.

Figure 20A:
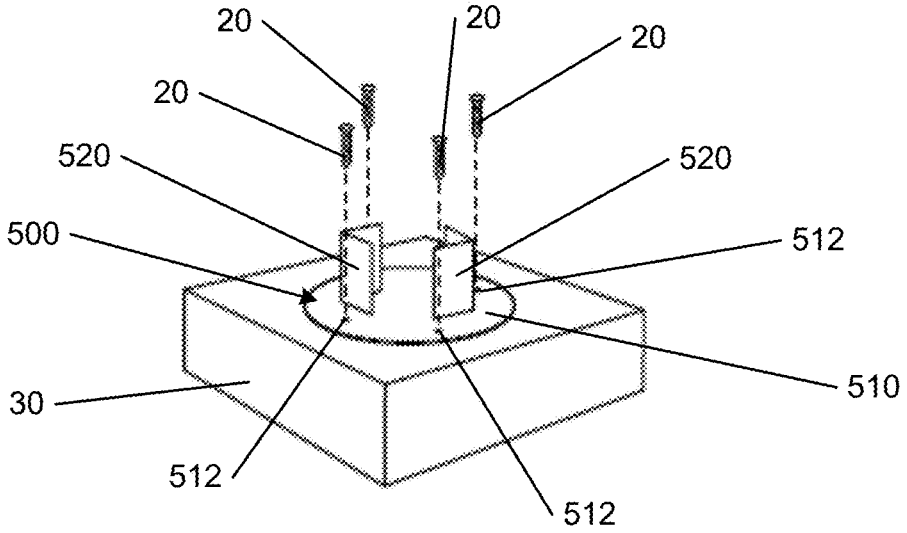
FIGS. 20A-20C are perspective views of an exemplary support post installed on the post base from FIG. 19 according to one or more aspects described herein.
Figure 20B:
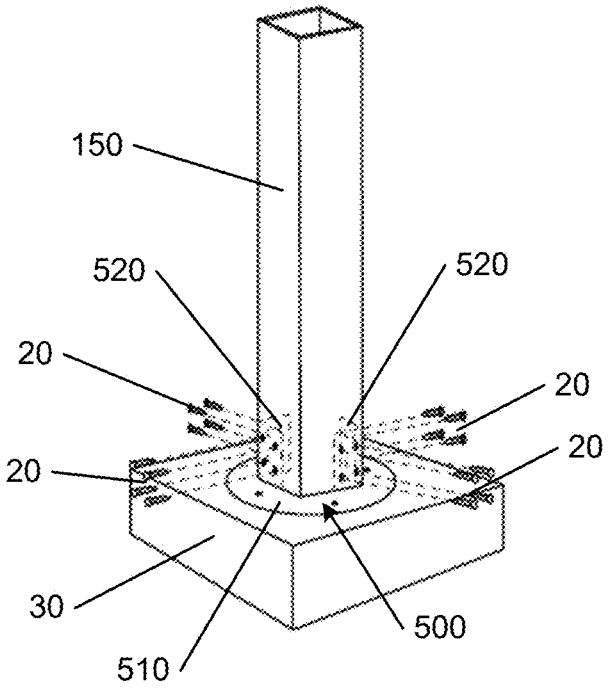
Figure 20C:
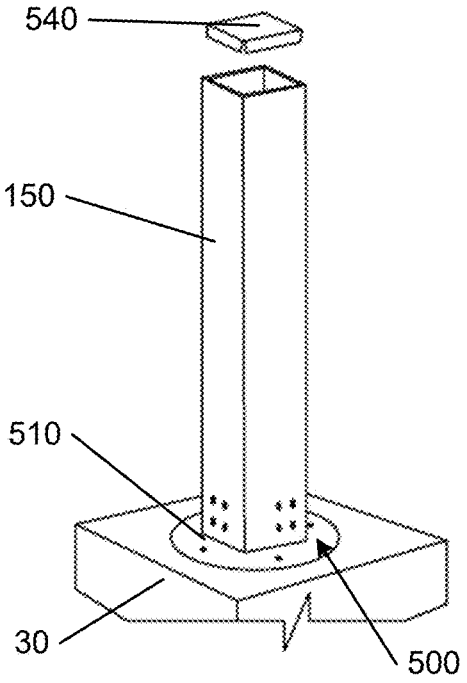

FIGS. 20A-20C depict an exemplary installation of the post base 500 with a support post 150. FIG. 20A depicts installing the post base 500 on a footing 30 and using four anchors or fasteners 20 through the fastener holes 512 to secure the post base 500 to the footing 30. FIG. 20B depicts sliding the support post 150 over the post base 500. The support post 150 must be turned such that the vertical supports 520 line up with the corners of the support post 150. Once the support post 150 slides over the vertical supports 520, fasteners 20 can be utilized through the support post 150 and the vertical supports 520 to ensure a secure fit between the support post 150 and the post base 500. FIG. 20C depicts installing and securing a post cap 540 on top of the support post 150 using an outdoor-grade sealant or other suitable glue-type material.

The post base 500 and the post cap 540 may be made of various materials. For example, the post base 500, the helical base, and the post cap 540 may be made from A-500 grade B/C structural steel. The post base 500, the helical base, and the post cap 540 may be fabricated then with hot dip galvanized and powder coated. The post base 500 may be made from 1'2" thick base plate with ⅛" thick tabs welded to the base plate for attachment to the support posts. The post cap 540 may be ¼" thick steel with a cross member welded to the post cap 540 for centering onto the support posts. The post base 500 and the post cap 540 may also provide a sustainable material, utilizing at least 25% recycled steel, that is 100% recyclable. The post base 500 and the post cap 540 may also be code-listed for exterior use.

Figure 21A:
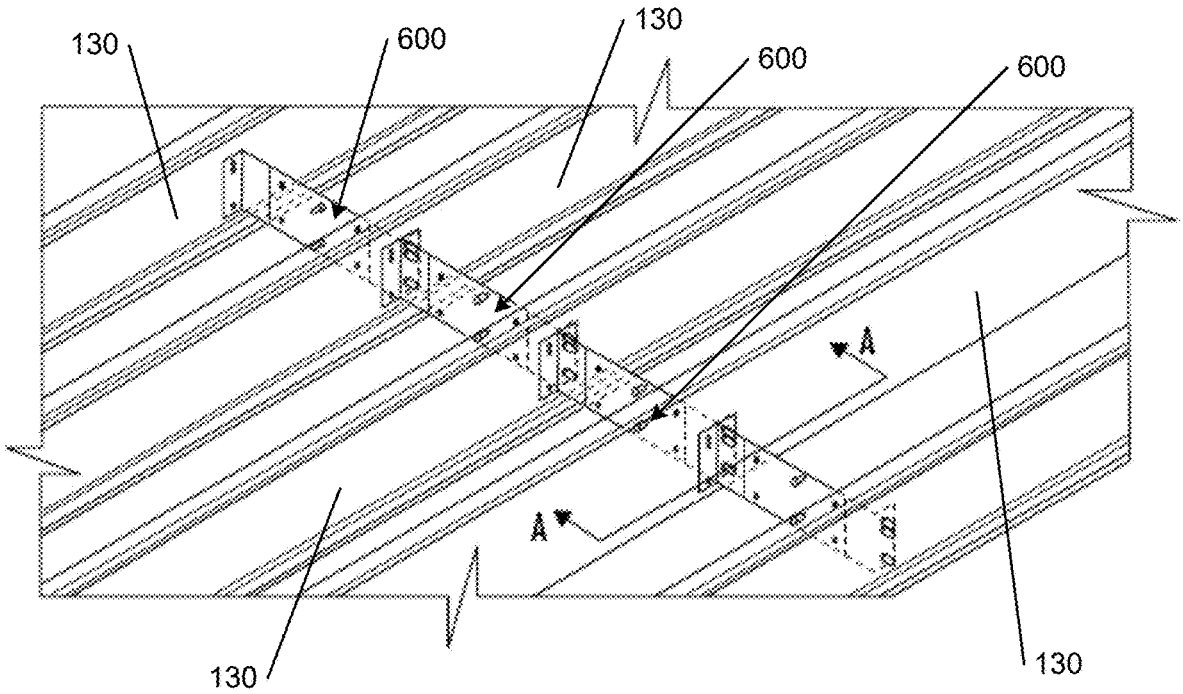
FIGS. 21A and 21B are views of an exemplary adjustable mid-span blocking feature for the metal substructure framing system according to one or more aspects described herein.
Figure 21B:
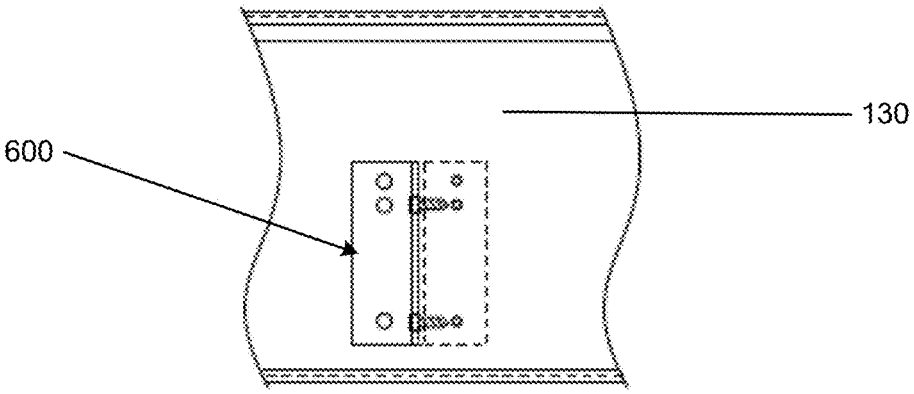
Figure 22A:
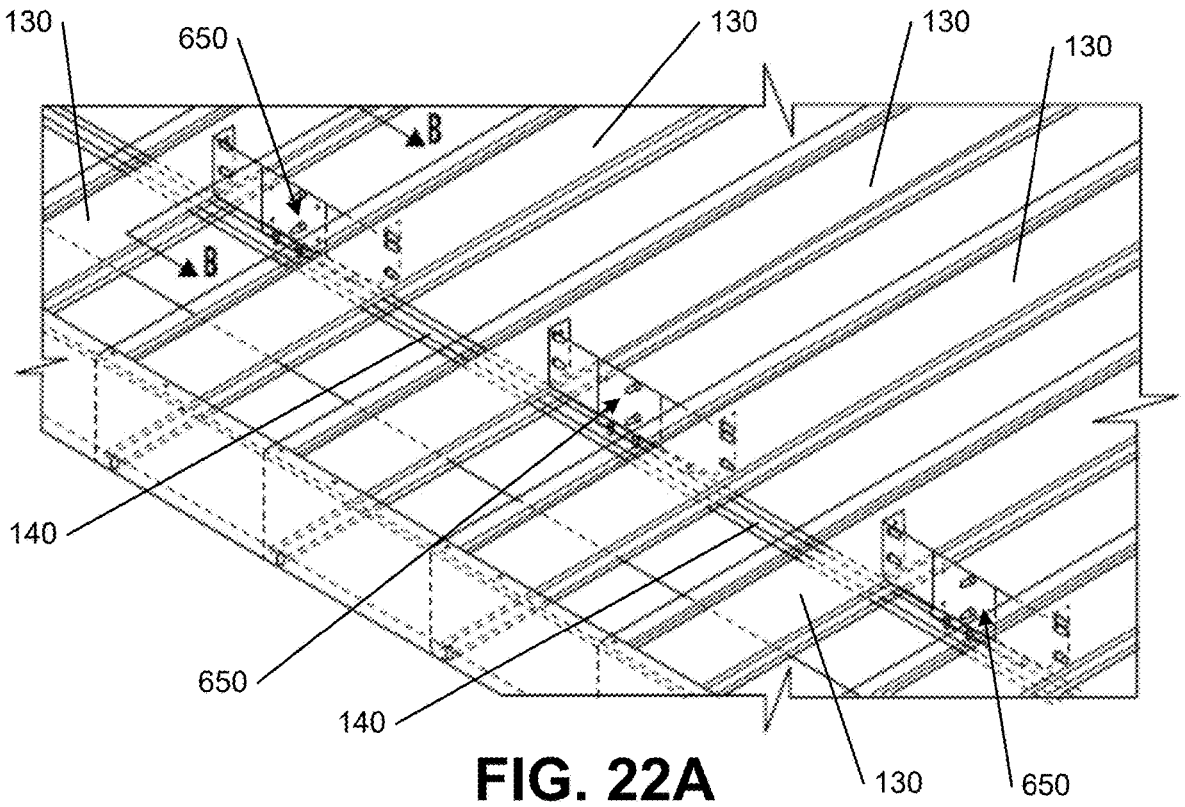
FIGS. 22A and 22B are views of an exemplary adjustable above beam blocking feature for the metal substructure framing system according to one or more aspects described herein.
Figure 22B:
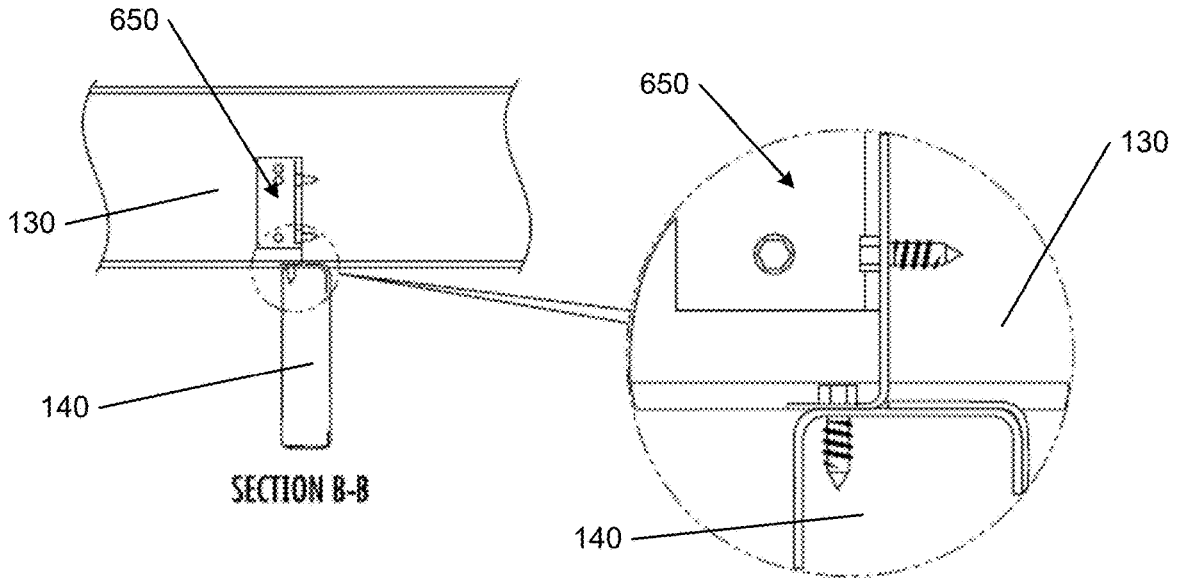
Figure 23:
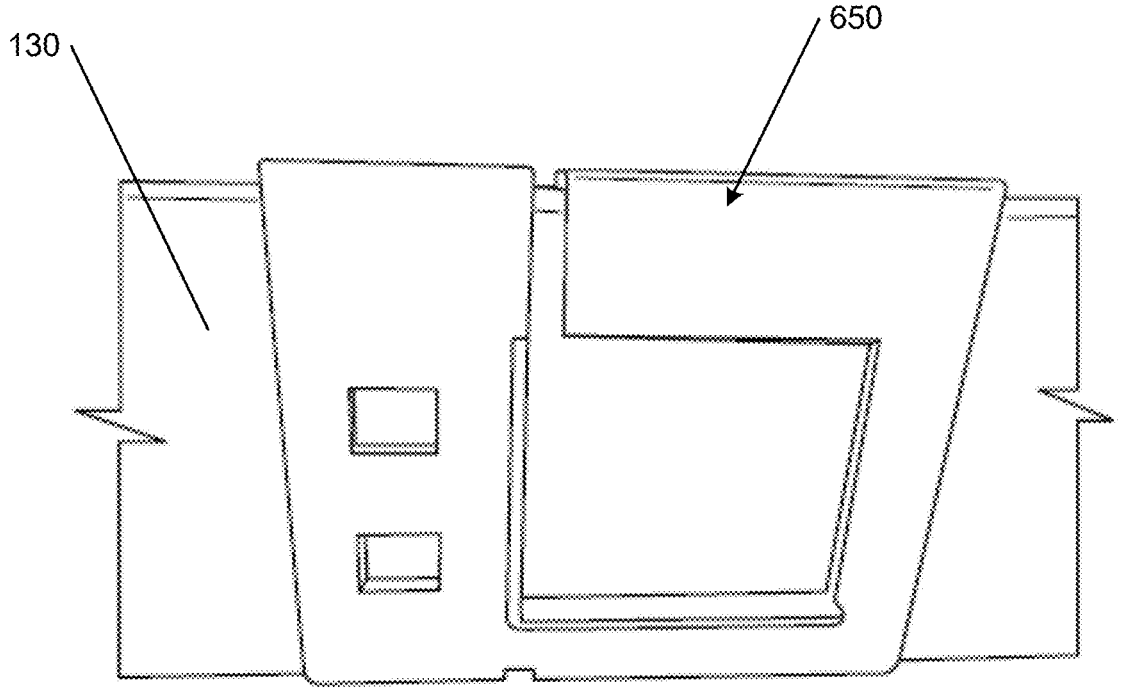
FIG. 23 is a perspective view of an exemplary installation tool for use with the metal substructure framing system according to one or more aspects described herein.

In addition, in some examples, the metal substructure framing system 100 may include adjustable blocking features. FIGS. 21A and 21B depict an exemplary adjustable mid-span blocking feature for the metal substructure framing system 100 that provides adjustability between 9 and 16 inches between joists 130 and fits any width for the joists 130. As shown in FIGS. 21A and 21B, an adjustable mid-span blocking 600 may be installed in between adjacent joists 130. The adjustable mid-span blocking 600 may help to provide support to prevent the joists 130 from sagging or warping under the load of the metal substructure framing system 100. FIGS. 22A and 22B depict an exemplary adjustable above beam blocking feature for the metal substructure framing system 100 that also provides adjustability between 9 and 16 inches between joists 130 and fits any width for the joists 130. As shown in FIGS. 22A and 22B, an adjustable beam blocking 650 may be installed in between adjacent joists 130 and above the support beams 140. The adjustable beam blocking 650 may help to provide stability and support for the joists 130 and prevent twisting, flexing and movement of the metal substructure framing system 100. The adjustable beam blocking 650 may also provide a web stiffener and connect to the joists 130 and support beams 140. Additionally, as shown in FIG. 23, an installation jig tool 670 may be utilized with a joist 130 to assist with and ensure alignment during the adjustable blocking installation process.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

I claim:

1. A metal substructure framing system, comprising:

at least one ledger track configured for attachment to an upright structure;

at least one track positioned opposite the ledger track;

a plurality of joists spanning between the ledger track and the at least one track;

at least one support beam extending underneath and transversely across the plurality of joists, wherein the ledger track, the at least one track, the joists, and each support beam comprises a hollow rectangular cross-section fabricated from galvanized steel;

a plurality of vertical support posts extending downward from the metal substructure framing system to a foundation or ground surface; and a stair assembly coupled to at least one end of the metal substructure framing system to provide access between an elevated deck and the foundation or ground surface, the stair assembly comprising:

a plurality of stair stringers, each stair stringer formed from a laser-cut steel sheet, a plurality of rises, a plurality of runs, wherein the stair stringers with the plurality of rises and the plurality of runs form a hollow structural member with steps defined by the rises and runs;

a plurality of stair stringer brackets configured to connect each of the stair stringers to the at least one track or the joist of the metal substructure framing system; and a pair of stair stringer handrail post brackets configured to attach to a handrail post, wherein the stair stringer handrail post brackets are configured to span between two adjacent stair stringers, wherein each stair stringer comprises:

a first side panel including the plurality of rises welded onto the first side panel, a second side panel including the plurality of runs welded onto the second side panel, and a bottom panel disposed between the first and second side panels, the bottom panel including an upper edge panel and a lower edge panel, wherein the first and second side panels are folded to form the hollow structural member.

2. The metal substructure framing system of claim 1, wherein the at least one support beam comprises a single beam or a double beam configuration.

3. The metal substructure framing system of claim 1, wherein a wall thickness of the hollow rectangular cross-sections is between 0.04 inches and 0.10 inches.

4. The metal substructure framing system of claim 1, wherein the galvanized steel is selected from 14-gauge steel and 18-gauge steel.

5. The metal substructure framing system of claim 1, wherein the joists include a joist section and a track section integrated to form the hollow rectangular cross-section.

6. The metal substructure framing system of claim 1, wherein the ledger track extends laterally across a width of the metal substructure framing system and is fastened directly to a building wall or house.

7. The metal substructure framing system of claim 1, wherein the at least one support beam extends transversely across and beneath the joists, providing structural support to distribute load.

8. The metal substructure framing system of claim 1, wherein each of the ledger track, the at least one track, the joists, and the at least one support beam are pre-cut to a selected length from a group consisting of 12 feet, 16 feet, and 20 feet.

9. The metal substructure framing system of claim 1, further comprising:

a front post bracket configured to connect a support post to a ledger track or joist, wherein the front post bracket comprises:

a rectangular base having a plurality of fastener holes;

a rectangular post support portion extending from the base; and one or more post support wings extending from the post support portion and configured to engage the support post, wherein the front post bracket provides lateral sway protection.

10. The metal substructure framing system of claim 9, further comprising:

a rear post bracket configured to attach a support post to a ledger track or joist from a rear-facing side, wherein the rear post bracket comprises:

a rectangular base with a plurality of fastener holes, a post support portion bent from the base and configured to rest on a top portion of the support post, and one or more post support wings extending downward from the post support portion, wherein the rear post bracket provides lateral sway protection.

11. The metal substructure framing system of claim 9, further comprising:

a post base configured to secure a support post to a footing, the post base comprising:

a circular footing base having a plurality of fastener holes; and at least one vertical support extending perpendicular from the footing base and configured to be received within the support post.

12. The metal substructure framing system of claim 11, wherein the at least one vertical support comprises V-shaped sides configured to align with corners of a rectangular support post.

13. The metal substructure framing system of claim 9, further comprising:

an adjustable mid-span blocking member that provides support to resist sagging or warping of the joists under load, the mid-span blocking member configured to be installed between adjacent joists, wherein the mid-span blocking member is adjustable to fit joist spacing between 9 inches and 16 inches.

14. The metal substructure framing system of claim 9, further comprising:

an adjustable beam blocking member that provide lateral and torsional stability to the joists, the beam blocking member configured to be installed between adjacent joists and positioned above the at least one support beam, wherein the adjustable beam blocking member is adjustable to fit joist spacing between 9 inches and 16 inches.

15. A metal substructure framing system, comprising:

at least one ledger track configured for attachment to an upright structure;

at least one at least one track positioned opposite the ledger track;

a plurality of joists spanning between the ledger track and the at least one track;

at least one support beam extending underneath and transversely across the plurality of joists, wherein the ledger track, the at least one track, the joists, and each support beam comprises a hollow rectangular cross-section fabricated from galvanized steel;

a plurality of vertical support posts extending downward from the metal substructure framing system to a foundation or ground surface;

a front post bracket configured to connect a support post to a ledger track or joist, wherein the front post bracket comprises:

a rectangular base having a plurality of fastener holes;

a rectangular post support portion extending from the base; and one or more post support wings extending from the post support portion and configured to engage the support post, wherein the front post bracket provides lateral sway protection; and a stair assembly coupled to at least one end of the metal substructure framing system to provide access between an elevated deck and the foundation or ground surface, the stair assembly comprising:

a plurality of stair stringers, each stair stringer formed from a laser-cut steel sheet, a plurality of rises, a plurality of runs, wherein the stair stringers with the plurality of rises and the plurality of runs form a hollow structural member with steps defined by the rises and runs;

a plurality of stair stringer brackets configured to connect each of the stair stringers to the at least one track or the joist of the metal substructure framing system; and a pair of stair stringer handrail post brackets configured to attach to a handrail post, wherein the stair stringer handrail post brackets are configured to span between two adjacent stair stringers.

16. The metal substructure framing system of claim 15, wherein the at least one support beam comprises a single beam or a double beam configuration.

17. The metal substructure framing system of claim 15, wherein a wall thickness of the hollow rectangular cross-sections is between 0.04 inches and 0.10 inches.

18. The metal substructure framing system of claim 15, wherein the galvanized steel is selected from 14-gauge steel and 18-gauge steel.

19. The metal substructure framing system of claim 15, wherein the joists include a joist section and a track section integrated to form the hollow rectangular cross-section.

20. The metal substructure framing system of claim 15, wherein the ledger track extends laterally across a width of the metal substructure framing system and is fastened directly to a building wall or house.

21. The metal substructure framing system of claim 15, wherein the at least one support beam extends transversely across and beneath the joists, providing structural support to distribute load.

22. The metal substructure framing system of claim 15, wherein each of the ledger track, the at least one track, the joists, and the at least one support beam are pre-cut to a selected length from a group consisting of 12 feet, 16 feet, and 20 feet.

23. The metal substructure framing system of claim 15, further comprising:

a rear post bracket configured to attach a support post to a ledger track or joist from a rear-facing side, wherein the rear post bracket comprises:

a rectangular base with a plurality of fastener holes, a post support portion bent from the base and configured to rest on a top portion of the support post, and one or more post support wings extending downward from the post support portion, wherein the rear post bracket provides lateral sway protection.

24. The metal substructure framing system of claim 15, further comprising:

a post base configured to secure a support post to a footing, the post base comprising:

a circular footing base having a plurality of fastener holes; and at least one vertical support extending perpendicular from the footing base and configured to be received within the support post.

25. The metal substructure framing system of claim 24, wherein the at least one vertical support comprises V-shaped sides configured to align with corners of a rectangular support post.

26. The metal substructure framing system of claim 15, further comprising:

an adjustable mid-span blocking member that provides support to resist sagging or warping of the joists under load, the mid-span blocking member configured to be installed between adjacent joists, wherein the mid-span blocking member is adjustable to fit joist spacing between 9 inches and 16 inches.

27. The metal substructure framing system of claim 15, further comprising:

an adjustable beam blocking member that provide lateral and torsional stability to the joists, the beam blocking member configured to be installed between adjacent joists and positioned above the at least one support beam, wherein the adjustable beam blocking member is adjustable to fit joist spacing between 9 inches and 16 inches.

* * * * *